US010471746B2

(12) United States Patent
Kawamata

(10) Patent No.: US 10,471,746 B2
(45) Date of Patent: Nov. 12, 2019

(54) PRINTING APPARATUS

(71) Applicant: Brother Kogyo Kabushiki Kaisha, Nagoya-shi, Aichi-ken (JP)

(72) Inventor: Noriyuki Kawamata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 152 days.

(21) Appl. No.: 15/713,789

(22) Filed: Sep. 25, 2017

(65) Prior Publication Data

US 2018/0264859 A1 Sep. 20, 2018

(30) Foreign Application Priority Data

Mar. 17, 2017 (JP) ..... 2017-052229

(51) Int. Cl.

| | |
|---|---|
| ***B41J 13/00*** | (2006.01) |
| ***B26D 5/08*** | (2006.01) |
| ***B26D 3/08*** | (2006.01) |
| ***B41J 11/66*** | (2006.01) |
| ***B41J 11/70*** | (2006.01) |
| *B41J 3/407* | (2006.01) |

(52) U.S. Cl.

CPC ..... *B41J 13/0009* (2013.01); *B26D 3/085* (2013.01); *B26D 5/08* (2013.01); *B41J 11/663* (2013.01); *B41J 11/666* (2013.01); *B41J 11/703* (2013.01); *B41J 3/4075* (2013.01); *B65H 2513/42* (2013.01)

(58) Field of Classification Search

CPC .... B41J 13/0009; B41J 11/663; B41J 11/703; B41J 11/666; B41J 3/4075; B26D 3/085; B26D 5/08; B65H 2513/42

See application file for complete search history.

(56) References Cited

U.S. PATENT DOCUMENTS

| | | | | |
|---|---|---|---|---|
| 5,222,818 | A | 6/1993 | Akiyama et al. | |
| 2009/0319072 | A1* | 12/2009 | Fukui | B41J 3/4075 700/110 |
| 2015/0084262 | A1 | 3/2015 | Sago et al. | |
| 2016/0271975 | A1* | 9/2016 | Kondo | B41J 11/703 |

FOREIGN PATENT DOCUMENTS

| | | | |
|---|---|---|---|
| JP | H10-230653 | A | 9/1998 |
| JP | 2000-006480 | A | 1/2000 |
| JP | 2015-085507 | A | 5/2015 |

* cited by examiner

*Primary Examiner* — David H Banh
(74) *Attorney, Agent, or Firm* — Banner & Witcoff, Ltd.

(57) ABSTRACT

A printing apparatus includes: a conveyor which conveys a print medium along a conveyance path; a print head which execute printing at a first position on the conveyance path; a cutter which cuts the print medium at least partially at a second position on the downstream side from the first position in the conveyance path; and a processor. The processor acquires a specified length along the conveyance path, acquires a first margin length along a conveyance direction in a first margin part, acquires a separation distance along the conveyance path between the first position and a third position which includes the second position and which is located on the conveyance path and between the first position to the second position, and determines whether the separation distance is equal to or longer than a first total length which is the total of the specified length and the first margin length.

6 Claims, 19 Drawing Sheets

PRINTING APPARATUS

CROSS REFERENCE TO RELATED APPLICATION

The present application claims priority from Japanese Patent Application No. 2017-052229, filed on Mar. 17, 2017, the disclosure of which is incorporated herein by reference in its entirety.

FIELD OF THE INVENTION

The present invention relates to printing apparatuses.

DESCRIPTION OF THE RELATED ART

Conventionally, there is known a printing apparatus capable of cutting a print media that has been printed. For example, in a conventional tape printer, a tape print head executes printing on a tape-like member fed by a tape feed means. The tape-like member finished with the printing is cut by a tape cutting means. The tape cutting means is arranged in front of the tape print head in a tape feed direction. If the tape-like member has a forepart margin where no printing is carried out, then it is necessary for the tape printer to feed the tape-like member by a predetermined length before starting to print. The tape printer acquires data of the forepart margin from print data. If the length of the forepart margin is shorter than the separate distance between the printing position of the print head and the cutting position of the cutting means, then the tape printer cuts the tape-like member after the tape-like member is fed by the length of difference between the length of the forepart margin and the separate distance from the printing position to the cutting position.

SUMMARY

For example, the abovementioned tape printer may include a half-cut mechanism. The half-cut mechanism carries out half-cutting to cut the print tape among the print tape and the release paper of the tape-like member. In such a case, after the tape-like member is fed by the length of difference between the length of the forepart margin and the separate distance from the printing position to the cutting position, the tape printer half-cuts the tape-like member with the half-cut mechanism. In this case, a user, for example, detaches the release paper from the tape-like member while holding a non-print part (to be referred to below as "non-print end portion") of the tape-like member from the half-cut part to the downstream end along a conveying direction. In the tape printer, for example, if the length of the forepart margin is approximately identical to the separate distance between the printing position and the cutting position, then the non-print end portion of the tape-like member substantially disappears. In this manner, in the tape printer, with the length of the forepart margin, variation may occur in the length of the non-print end portion of the tape-like member. For example, if there is variation in the length of the non-print end portion in the tape-like member, then it is possible to have difficulty in detaching the release paper from the tape-like member while holding the non-print end portion. Therefore, if the half-cut mechanism half-cuts the tape-like member, then in consideration of controlling the tape printer, it is possible for the user to have difficulty in handling the tape-like member finished with printing.

An object of the present teaching is to provide a printing apparatus able to lessen the size of a non-print end portion of a print medium while securing the ease for a user to handle the print medium.

According to an aspect of the present teaching, there is provided a printing apparatus including: a conveyor configured to convey an elongate print medium along a conveyance path; a print head configured to execute printing on the print medium at a first position on the conveyance path; a cutter configured to cut the print medium at least partially at a second position on the downstream side of the first position in the conveyance path; and a processor configured to control the conveyor, the print head, and the cutter, wherein the processor is configured to: acquire a specified length along the conveyance path; acquire a first margin length along the conveyance direction in a first margin part provided in the print medium on the downstream side in the conveyance direction from a print part where printing is carried out; acquire a separation distance along the conveyance path between the first position and a third position which includes the second position, the third position being located on the conveyance path between the first position and the second position; and determine whether the separation distance is equal to or longer than a first total length which is the total of the specified length and the first margin length, if the processor determines that the separation distance is equal to or longer than the first total length, the processor is configured to execute: a first process of letting the conveyor start conveying the print medium and letting the print head start printing on the print medium, printing on the print medium while conveying the print medium by a first differential length which is the difference between the separation distance and the first margin length, and then letting the conveyor stop conveying the print medium and letting the print head stop printing on the print medium; a second process of letting the cutter partially cut the print medium after the first process; and a third process of letting the conveyor restart conveying and letting the print head restart printing after the second process, to print on the print medium while conveying the print medium, if the processor determines that the separation distance is shorter than the first total length, the processor is configured to determine whether the first margin length is equal to or longer than the separation distance; if the processor determines that the first margin length is equal to or longer than the separation distance, the processor is configured to execute: a fourth process of letting the conveyor start conveying the print medium, conveying the print medium by the specified length, and then letting the conveyor stop conveying the print medium; a fifth process of letting the cutter partially cut the print medium after the fourth process; a sixth process of letting the conveyor restart conveying the print medium after the fifth process; and a seventh process of letting the print head start to print on the print medium when the print medium is conveyed by the first differential length after the sixth process, to print on the print medium while conveying the print medium; and if the processor determines that the first margin length is shorter than the separation distance, the processor is configured to execute: an eighth process of letting the conveyor start conveying the print medium; a ninth process of letting the print head start printing on the print medium when the print medium is conveyed by the differential length between the separation distance and the first total length after the eighth process, letting the print head print on the print medium while conveying the print medium by the first differential length, and then letting the conveyor stop conveying the print medium and letting the print head stop printing on the print medium; a tenth process of letting the cutter partially cut the print medium after the ninth process; and an eleventh process of letting the conveyor restart conveying the print medium and letting the print head restart printing on the print medium after the tenth process, to print on the print medium while conveying the print medium.

According to the above printing apparatus, if the separation distance is the first total length or longer, then the first differential length between the separation distance and the first differential length is secured as a non-print part (to be referred below as "non-print end portion") ranging from the part at which part the print medium is cut to the end on the downstream side in the conveyance direction. If the separation distance is shorter than the first total length, then the specified length is secured as the non-print end portion. The first differential length is the specified length or longer. Hence, the printing apparatus can secure at least the specified length or at most the first differential length as the non-print end portion, according to the separation distance, the specified length, and the first margin length. For example, a user can hold the non-print end portion where at least the specified length is secured, to handle the printed print medium. Therefore, the printing apparatus can lessen the size of the non-print end portion while securing the ease for the user to handle the print medium.

DESCRIPTION OF THE EMBODIMENT

Referring to the accompanying drawings, a preferred embodiment of the present teaching will be explained. In the following explanation, the right lower side, left upper side, left lower side, right upper side, upper side and lower side with respect to FIG. 1 are defined respectively as the front side, rear side, left side, right side, upper side and lower side with respect to a printing apparatus 1 and a tape cassette 30.

Figure 1:
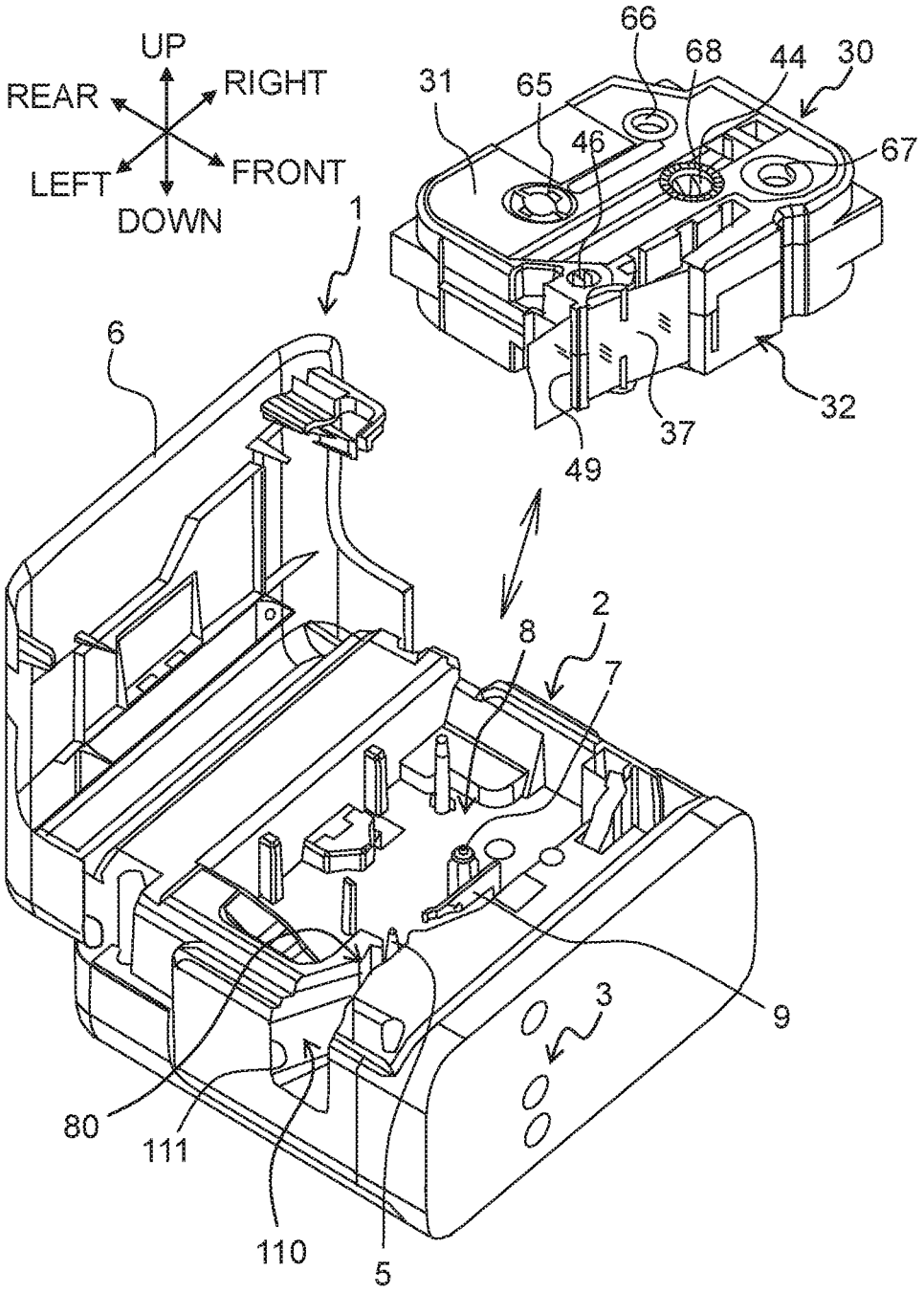
FIG. 1 is a perspective view of a printing apparatus and a tape cassette according to the present teaching.
Figure 2:
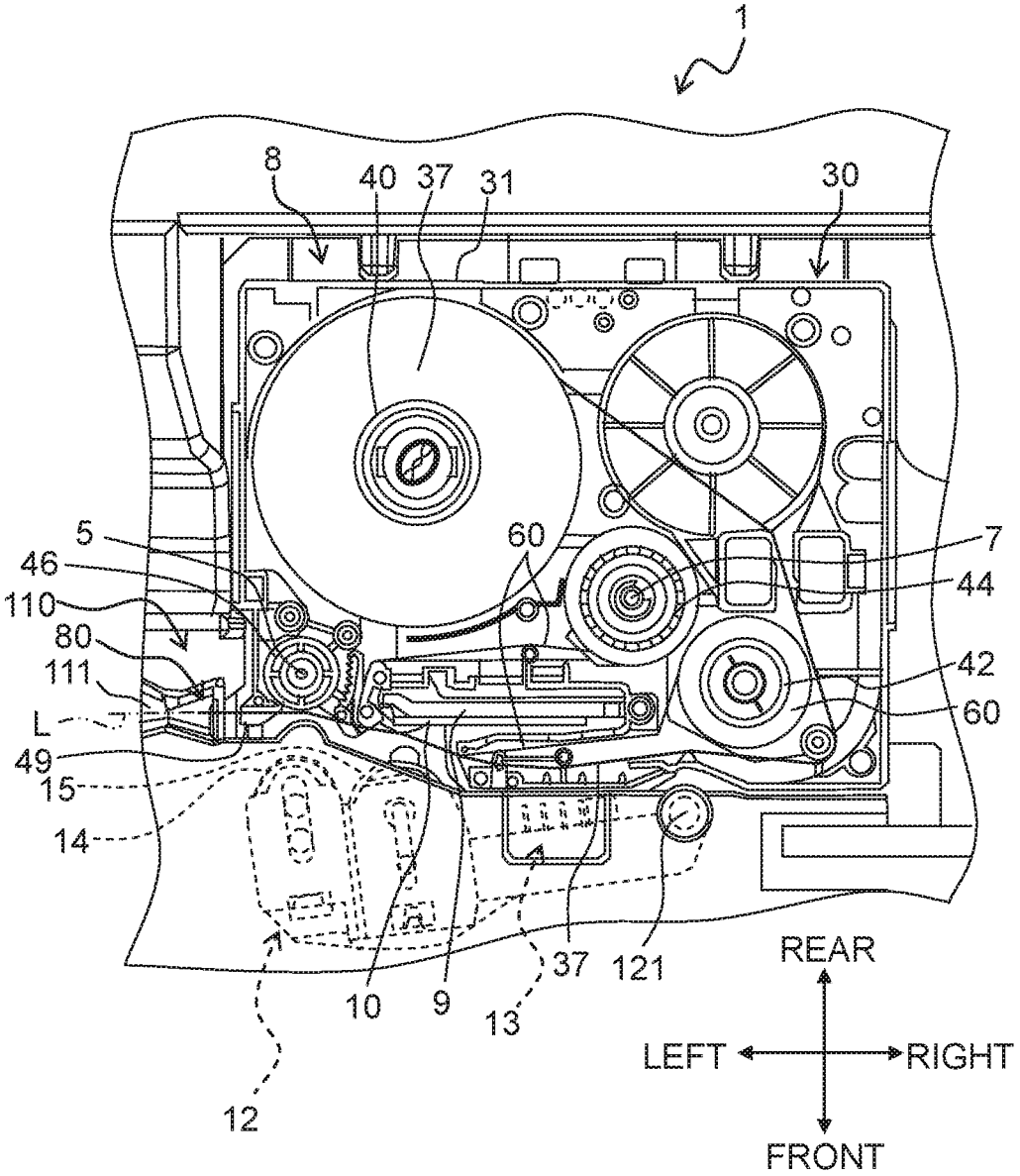
FIG. 2 is a plan view depicting a state where the tape cassette of a receptor type is installed in an installation portion of the printing apparatus.

Referring to FIGS. 1 to 4, the printing apparatus 1 and the tape cassette 30 will be explained. In FIG. 2, in order to facilitate understanding, the upper side of a cassette case 31 is removed. Various types of tape cassettes can be used in the one printing apparatus 1 (such as a thermal type, receptor type, laminate type, tube type, and the like). Hereinbelow, the word "tape" will be used to collectively refer to various elongate print media accommodated in the tape cassette 30 (for example, a thermal paper tape, a print tape 37, two-sided adhesive tape, tube tape, and film tape). The printing apparatus 1 can be connected to an external terminal (not depicted) via a cable (not depicted). For example, the printing apparatus 1 prints an image including a character line 51 (to be referred to below as "print image 50") based on print data sent from the external terminal (see FIG. 6 and the like). The character line 51 is composed of at least one character (letter, number, figure, or the like). The external terminal is, for example, a personal computer (PC).

As depicted in FIG. 1, the printing apparatus 1 includes a main body cover 2. The main body cover 2 is approximately cuboid. An input unit 3 is provided on the front surface of the main body cover 2. The input unit 3 is a switch to input various kinds of information to the printing apparatus 1, and includes the power switch of the printing apparatus 1. The main body cover 2 is provided with an installation portion 8. The installation portion 8 is a recess into which the tape cassette 30 will be installed in a removable manner.

A cassette cover 6 is provided above the installation portion 8. The cassette cover 6 is an approximately rectangular cover in planar view, and is supported by a shaft at the left and right sides above the rear surface of the main body cover 2. The cassette cover 6 is revolvable between a closed position (not depicted) to cover the installation portion 8 from above and an open position (see FIG. 1) to open the installation portion 8. The cassette cover 6 is opened and closed when the tape cassette 30 is replaced.

A discharge port 111 is provided in the left lateral side of the main body cover 2. The discharge port 111 is an opening to discharge the tape finished with printing from the installation portion 8. The main body cover 2 has a tape discharge portion 110. The tape discharge portion 110 is a recess concaved downward, and is provided between the installation portion 8 and the discharge port 111.

As depicted in FIGS. 1 and 2, the tape cassette 30 includes a cassette case 31. The cassette case 31 is box-like, and has a tape drive roller 46 and support holes 65 to 68. The tape drive roller 46 is provided in the left front corner of the cassette case 31. The cylindrical tape drive roller 46 extends in a vertical or up-down direction, and is rotatably supported by the cassette case 31. The support hole 65 rotatably supports a first tape spool 40. A first tape is wound around the first tape spool 40. The support hole 67 rotatably supports a ribbon spool 42. An unused ink ribbon 60 is wound around the ribbon spool 42. The support hole 68 rotatably supports a ribbon take-up spool 44. The used ink ribbon 60 is wound around the ribbon take-up spool 44. The support hole 66 rotatably supports a second tape spool (not depicted). A second tape is wound around the second tape spool. A guide portion 49 is provided on a left front portion of the cassette case 31. The guide portion 49 guides the tape discharged from the tape cassette 30. An index portion 32 is provided on the front surface of the tape cassette 30. The index portion 32 is formed with switch holes of a pattern corresponding to various tapes accommodated in the tape cassette 30 (to be referred to below as "formation pattern").

By appropriately changing the type of the tape accommodated inside the cassette case 31, using or not using the ink ribbon 60, etc., the tape cassette 30 is installable with the aforementioned thermal type, receptor type, laminate type, tube type, and the like. FIG. 2 exemplifies the tape cassette 30 of the receptor type. In the tape cassette 30 of the receptor type, the support hole 65 supports the first tape spool 40 around which a print tape 37 is wound as the first tape. Because the second tape is not used in the tape cassette 30 of the receptor type, the support hole 66 does not support the second tape spool. For example, in a tape cassette of the laminate type (not depicted), the support hole 65 supports the first tape spool 40 around which a two-sided adhesive tape is wound as the first tape. The support hole 66 supports the second tape spool around which a film tape is wound as the second tape.

Figure 3:
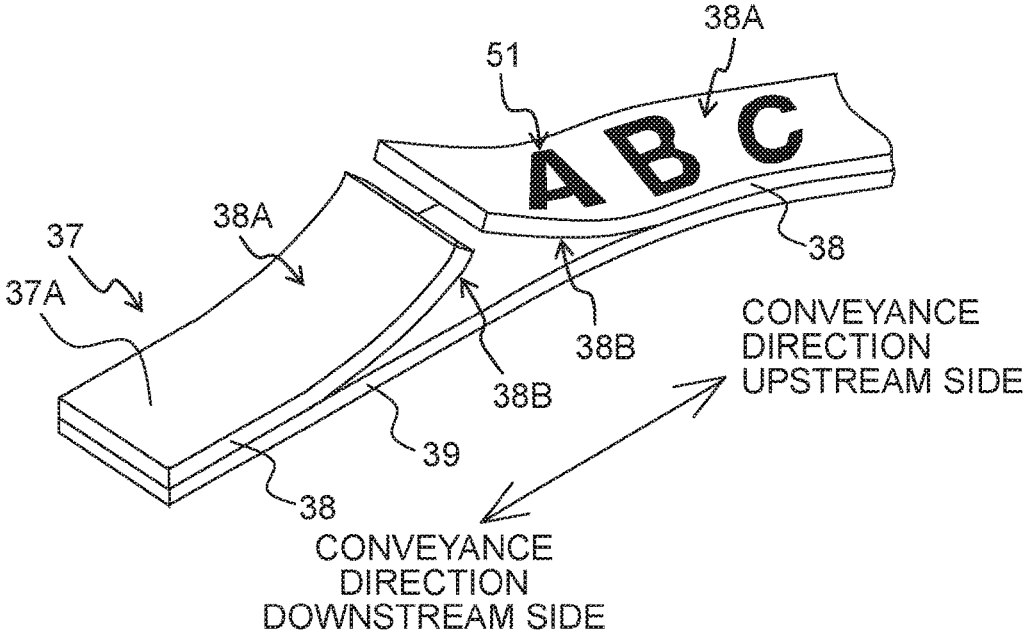
FIG. 3 depicts a print tape when a character line is printed thereon to depict "ABC".

As depicted in FIG. 3, the print tape 37 of this embodiment is formed from a plurality of layers including an adhesive tape 38 and a release paper 39. The surface of the adhesive tape 38 is a print surface 38A on which the character line 51 is printed. The rear surface of the adhesive tape 38 is an adhesive surface 38B formed of an adhesive layer. The release paper 39 is stuck on the adhesive surface 38B.

As depicted in FIG. 2, a head holder 9 is provided to stand in a front portion of the installation portion 8. A thermal head 10 is provided on the front surface of the head holder 9. The thermal head 10 includes a plurality of heating elements (not depicted) aligning in the up-down direction to carry out printing in lines. A ribbon take-up shaft 7 is provided to stand in the rear of the head holder 9. The ribbon take-up shaft 7 is removable from the ribbon take-up spool 44. A tape drive shaft 5 is provided to stand on the left side of the head holder 9. The tape drive shaft 5 is removable from the tape drive roller 46.

A platen holder 12 is arranged in front of the head holder 9. The platen holder 12 is swingable about a shaft support portion 121 in a front-rear direction. A platen roller 15 and a movable conveyance roller 14 are rotatably supported by shafts, respectively, at the left end of the platen holder 12. The platen roller 15 is contactable with and separable from the thermal head 10 across a tape conveyance path L. The movable conveyance roller 14 is contactable with and separable from the tape drive roller 46 installed on the tape drive shaft 5 across the conveyance path L. The tape drive shaft 5 is driven to rotate by a tape drive motor 18 (see FIG. 5). Along with the rotation of the tape drive shaft 5, the tape drive roller 46 rotates to convey, along the conveyance path L, the tape 37 nipped between the movable conveyance roller 14 and the tape drive roller 46. On this occasion, the width direction of the tape 37 is the up-down direction. The thickness direction of the tape 37 is the front-rear direction. The conveyance path L is along a virtual line orthogonal to the direction (the up-down direction) in which the plurality of heating elements are aligned in the thermal head 10. The platen holder 12 is provided with a plurality of switch sensors 13. Each of the switch sensors 13 can approach the platen holder 12 and withdraw therefrom.

If the cassette cover 6 (see FIG. 1) revolves from the open position to the closed position, then the platen holder 12 swings rearward about the shaft support portion 121, approaching the installation portion 8. The platen roller 15 and the movable conveyance roller 14 are arranged inside the installation portion 8. On this occasion, the platen roller 15 biases the print tape 37 and the ink ribbon 60 superimposed on each other toward the thermal head 10. The ink surface of the ink ribbon 60 is superimposed on the print surface 38A. Along with this, each of the switch sensors 13 is biased to the index portion 32. Each of the switch sensors 13 is selectively pressed in accordance with the formation pattern of the switch holes of the index portion 32. The movable conveyance roller 14 and the tape drive roller 46 nip the print tape 37 and the ink ribbon 60 of the tape cassette 30. The printing apparatus 1 is then in a state where the tape cassette 30 can be used for printing on the print tape 37.

Figure 4:
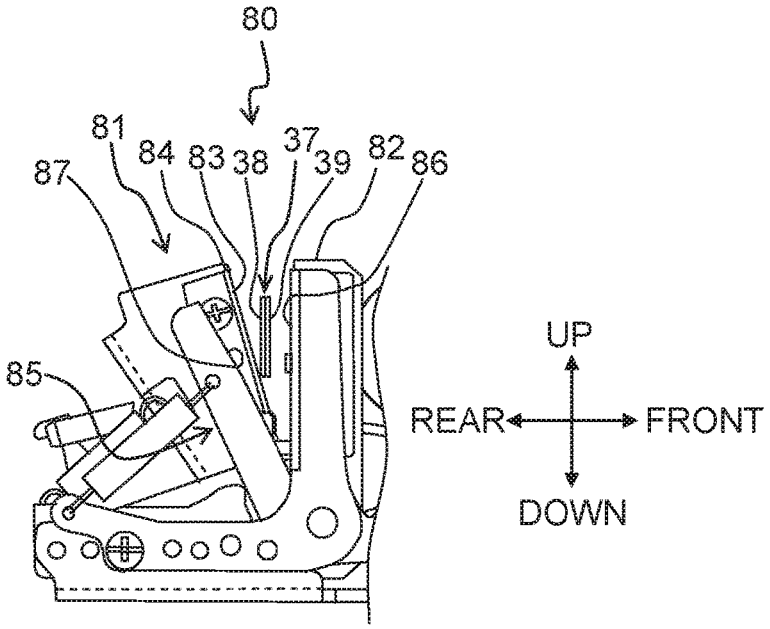
FIG. 4 is a left lateral view of a cutting mechanism.

Referring to FIG. 4, a cutting mechanism 80 will be explained. Cutting mechanisms are publicly known. Therefore, the cutting mechanism 80 will be explained in a simplified manner. The cutting mechanism 80 is provided in the tape discharge portion 110 (see FIG. 2). That is, the cutting mechanism 80 is provided on the downstream side from the thermal head 10 (see FIG. 2) in the tape conveying direction. By carrying out a cutting operation, the cutting mechanism 80 cuts at least part of the printed tape along a direction orthogonal to the conveyance path L (along the tape thickness direction). The cutting operation of the cutting mechanism 80 includes a half-cut operation and a full-cut operation. The half-cut operation only cuts some layer or layers of the printed tape (for example, the adhesive tape 38 of the print tape 37) but does not cut the other layer or layers of the printed tape (for example, the release paper 39 of the print tape 37). The full-cut operation cuts all layers of the printed tape (for example, the adhesive tape 38 and the release paper 39 of the print tape 37), to cut up the printed tape into two parts.

The cutting mechanism 80 includes a cutter drive motor 19 (see FIG. 5), a half-cut mechanism 81, and a full-cut mechanism 85. The cutter drive motor 19 can rotate in a forward direction and the reverse direction. By switching the rotating direction, the cutter drive motor 19 can selectively carry out the half-cut operation or the full-cut operation. The half-cut mechanism 81 carries out the half-cut operation. The half-cut mechanism 81 includes a pedestal 82 and a cutting blade 83.

The pedestal 82 is approximately cuboid, and is arranged in front of the conveyance path L (see FIG. 2), in the tape discharge portion 110. The cutting blade 83 extends in the up-down direction, and is arranged in the rear of the conveyance path L. The pedestal 82 and the cutting blade 83 face each other across the conveyance path L in the front-rear direction. A projection 84 is provided on an upper end portion of the cutting blade 83. The projection 84 projects toward the pedestal 82 from the upper side of the cutting blade 83, and extends out a little from the cutting blade 83.

The full-cut mechanism 85 carries out the full-cut operation. The full-cut mechanism 85 includes a fixed blade 86 and a movable blade 87. The fixed blade 86 extends in the up-down direction, and is arranged in front of the conveyance path L in the tape discharge portion 110. The movable blade 87 also extends in the up-down direction, and is arranged in the rear of the conveyance path L. The fixed blade 86 and the movable blade 87 face each other across the conveyance path L in the front-rear direction. In this embodiment, with respect to the conveying direction, the half-cut mechanism 81 (in detail, the cutting blade 83) is positioned approximately in line with the full-cut mechanism 85 (in detail, the movable blade 87).

Next, an explanation will be made on the outline of the half-cut operation of the cutting mechanism 80. When the half-cut mechanism 81 carries out the half-cut operation, the cutter drive motor 19 rotates in the forward direction. If the cutter drive motor 19 rotates in the forward direction, then the cutting blade 83 moves frontward to approach the pedestal 82. On this occasion, the projection 84 comes to contact with the pedestal 82, thereby forming an interspace narrower than the tape thickness (for example, an interspace approximately equal to the thickness of the release paper 39) between the cutting blade 83 and the pedestal 82. The tape is positioned in the interspace between the cutting blade 83 and the pedestal 82, and pressed against the pedestal 82 by the cutting blade 83. By virtue of this, some layer of the tape (for example, the adhesive tape 38 of the print tape 37 beside the cutting blade 83) is cut up by the cutting blade 83.

Next, an explanation will be made on the outline of the full-cut operation of the cutting mechanism 80. When the full-cut mechanism 85 carries out the full-cut operation, the cutter drive motor 19 rotates in the reverse direction. If the cutter drive motor 19 rotates in the reverse direction, then the movable blade 87 moves frontward to intersect the fixed blade 86. By virtue of this, all layers of the tape (for example, the adhesive tape 38 and the release paper 39 of the print tape 37) are cut up between the movable blade 87 and the fixed blade 86.

Figure 5:
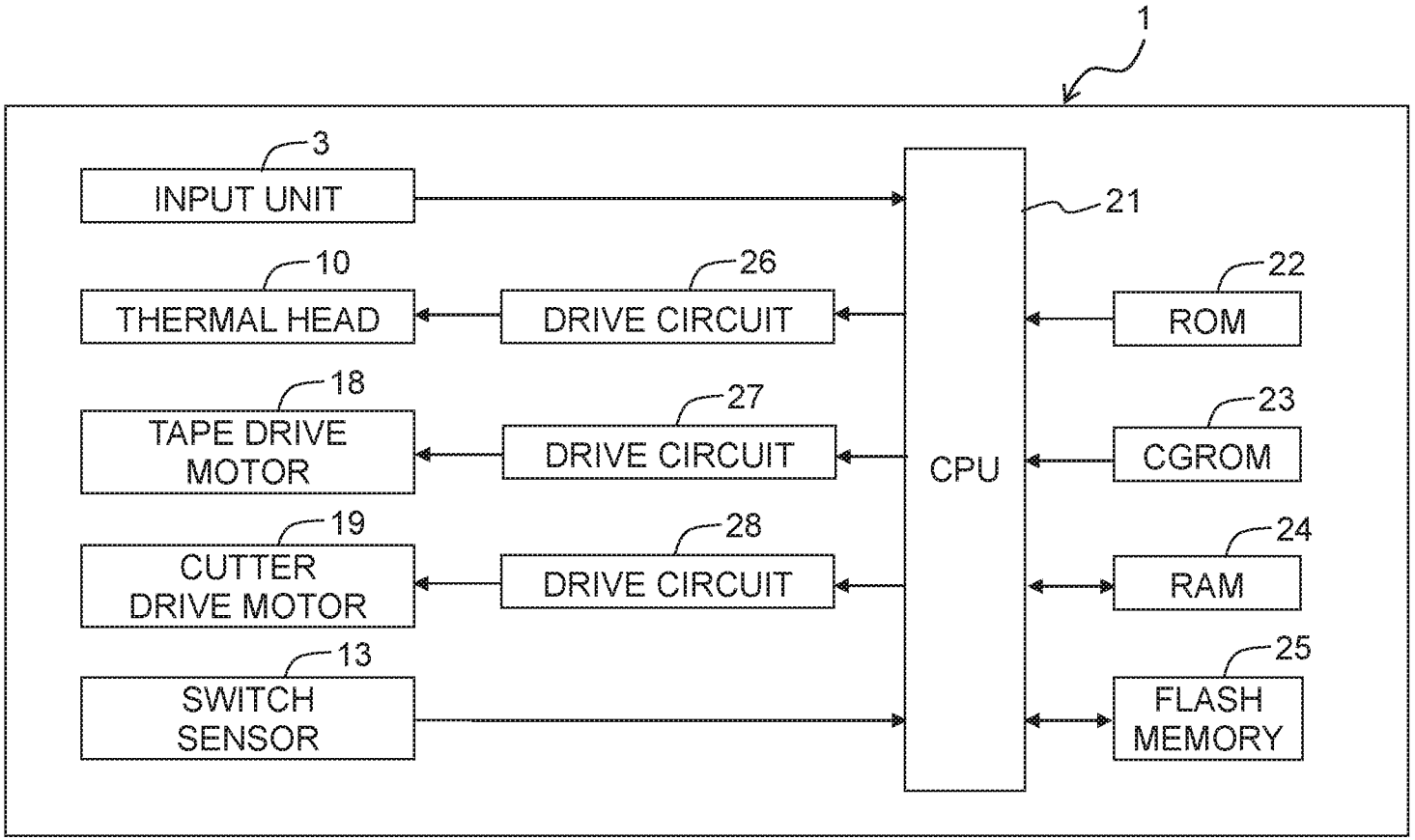
FIG. 5 is a block diagram depicting an electrical configuration of the printing apparatus.

Referring to FIG. 5, an electrical configuration of the printing apparatus 1 will be explained. The printing apparatus 1 includes a CPU 21 to collectively control the printing apparatus 1. The CPU 21 is connected electrically with a ROM 22, a CGROM 23, a RAM 24, a flash memory 25, an input unit 3, drive circuits 26, 27 and 28, and the respective switch sensors 13.

The ROM 22 stores various parameters needed for the CPU 21 to execute various programs. The ROM 22 stores, for example, an aftermentioned separation distance Z. The CGROM 23 stores dot pattern data for printing to print characters. The RAM 24 includes a plurality of storage areas such as a text memory, print buffer, and the like. The flash memory 25 stores various programs executed by the CPU 21 to control the printing apparatus 1. The flash memory 25 stores, for example, print data acquired beforehand from the external terminal.

The drive circuit 26 is an electronic circuit for driving the thermal head 10. The drive circuit 27 is an electronic circuit for driving the tape drive motor 18. The drive circuit 28 is an electronic circuit for driving the cutter drive motor 19. By being selectively pressed in accordance with the formation pattern of the switch holes of the index portion 32, the respective switch sensors 13 can detect the formation pattern of the switch holes of the index portion 32. The respective switch sensors 13 output the detected formation pattern to the CPU 21. The CPU 21 identifies the type of the tape based on the formation pattern outputted from the respective switch sensors 13.

Figure 6:
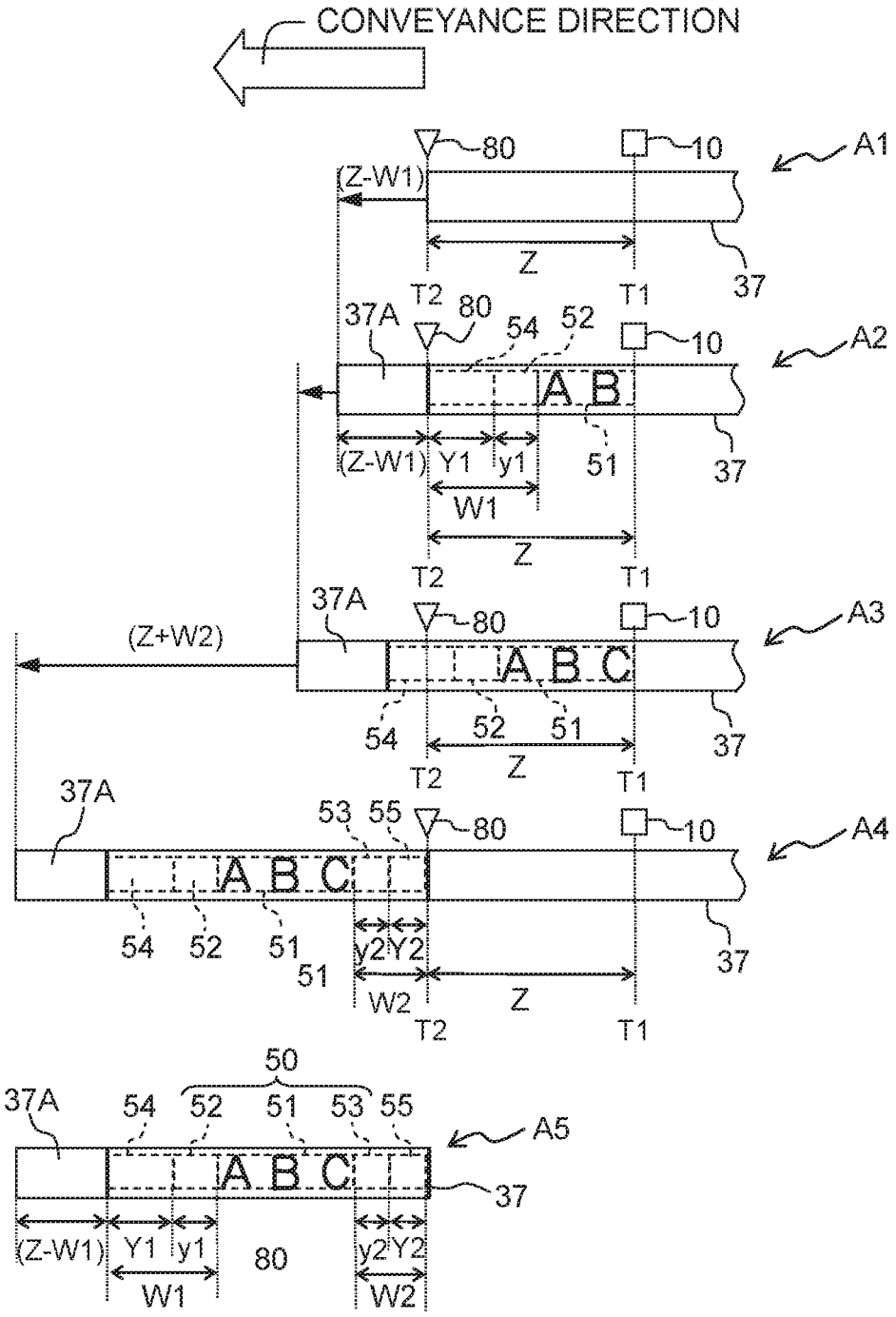
FIG. 6 is a state transition diagram of the print tape when a first control process is carried out.

Referring to a state A5 of FIG. 6, the print data of this embodiment will be explained. The print data are information for printing the print image 50. The print data include, for example, image data of the print image 50, etc. The print image 50 includes the character line 51. In FIG. 6, the character line 51 shows "ABC". The print image 50 may sometimes include a first blank area 52 and a second blank area 53. The first blank area 52 is provided on the downstream side from the character line 51 in the conveying direction as a blank (or namely a space) in the print image 50, where the character line 51 is not printed. The second blank area 53 is provided on the upstream side from the character line 51 in the conveying direction as another blank in the print image 50, where the character line 51 is not printed either.

Referring to FIG. 6, an explanation will be made on a specified length X, a first margin length Y1, a second margin length Y2, a first blank length y1, a second blank length y2, and the separation distance Z. In order to facilitate understanding, FIG. 6 schematically depicts a positional relation between the print tape 37, the thermal head 10, and the cutting mechanism 80 (much the same is true on FIGS. 9, 11 and 13). In this embodiment, the user can operate the input unit 3 to set the specified length X, the first margin length Y1, and the second margin length Y2. The specified length X indicates the length along the conveyance path L. While a detailed explanation will be made later on, the printing apparatus 1 of this embodiment can secure at least the specified length X as the length along the conveyance path L of the non-print part (to be referred to below as "non-print end portion 37A") from the part cut up in the half-cut operation to the downstream end in the conveying direction.

The first margin length Y1 and the second margin length Y2 indicate, respectively, the lengths of the first blank part 54 and the second blank part 55 along the conveying direction. The first blank part 54 is a margin provided on the downstream side in the conveying direction from the part where printing is carried out on the print tape 37 based on the print data (that is, the part where the print image 50 is printed, to be referred to below as "print part"). The second blank part 55 is a margin provided on the upstream side from the print part in the print tape 37 along the conveying direction. That is, the print image 50 is not printed in the first blank part 54 and the second blank part 55. The first blank length y1 and the second blank length y2 indicate, respectively, the lengths of the aforementioned first blank area 52 and second blank area 53 along the conveying direction.

The separation distance Z indicates the distance along the conveyance path L between a printing position T1 and a cutting position T2. The printing position T1 indicates the position on the conveyance path L where the thermal head 10 prints one line of the characters. In detail, the printing position T1 indicates the position where the plurality of heating elements of the thermal head 10 are provided along the conveying direction. The cutting position T2 indicates the position on the conveyance path L where the full-cut mechanism 85 cuts up the tape. In detail, the cutting position T2 indicates the position where the movable blade 87 intersects the conveyance path L in the full-cut operation. The cutting position T2 is on the downstream side from the printing position T1 along the conveyance path L. In this embodiment, the conveyance path L extends straight between the printing position T1 and the cutting position T2.

Hereinbelow, the term "first total length (X+Y1)" will be used to refer to the total of the specified length X and the first margin length Y1. The term "second total length (X+W1)" will be used to refer to the total of the specified length X, the first margin length Y1, and the first blank length y1. The term "third total length W1" will be used to refer to the total of the first margin length Y1 and the first blank length y1. The term "fourth total length W2" will be used to refer to the total of the second margin length Y2 and the second blank length y2. The term "fifth total length (Z+W2)" will be used to refer to the total of the separation distance Z and the fourth total length W2. The term "first differential length (Z−Y1)" or "first differential length (Y1−Z)" will be used to refer to the difference between the separation distance Z and the first margin length Y1. The term "second differential length (Z−W1)" or "second differential length (W1−Z)" will be used to refer to the difference between the separation distance Z and the third total length W1. The term "third differential length (X+W1−Z)" will be used to refer to the difference between the second total length (X+W1) and the separation distance Z. The term "fourth differential length (X+Y1−Z)" will be used to refer to the difference between the first total length (X+Y1) and the separation distance Z. Further, an aftermentioned first modification will be explained using the "first total length (X+Y1)", "first differential length (Z−Y1)", "first differential length (Y1−Z)", and "fourth differential length (X+Y1−Z)".

Referring to FIGS. 6 to 13, a main process will be explained. Hereinbelow, as depicted in FIGS. 6, 9, 11 and 13, suitable examples will be taken to explain a case of printing, on the print tape 37, the print image 50 including the first blank area 52 having the first blank length y1, the character line 51 showing "ABC", and the second blank area 53 having the second blank length y2. As described earlier on, the user has set the printing apparatus 1 in a state able to print on the tape using the tape cassette 30. The user presses the power switch of the input unit 3 to turn on the power of the printing apparatus 1. The CPU 21 starts the main process by executing a program stored in the ROM 22 if the power of the printing apparatus 1 is turned on.

Figure 7A:
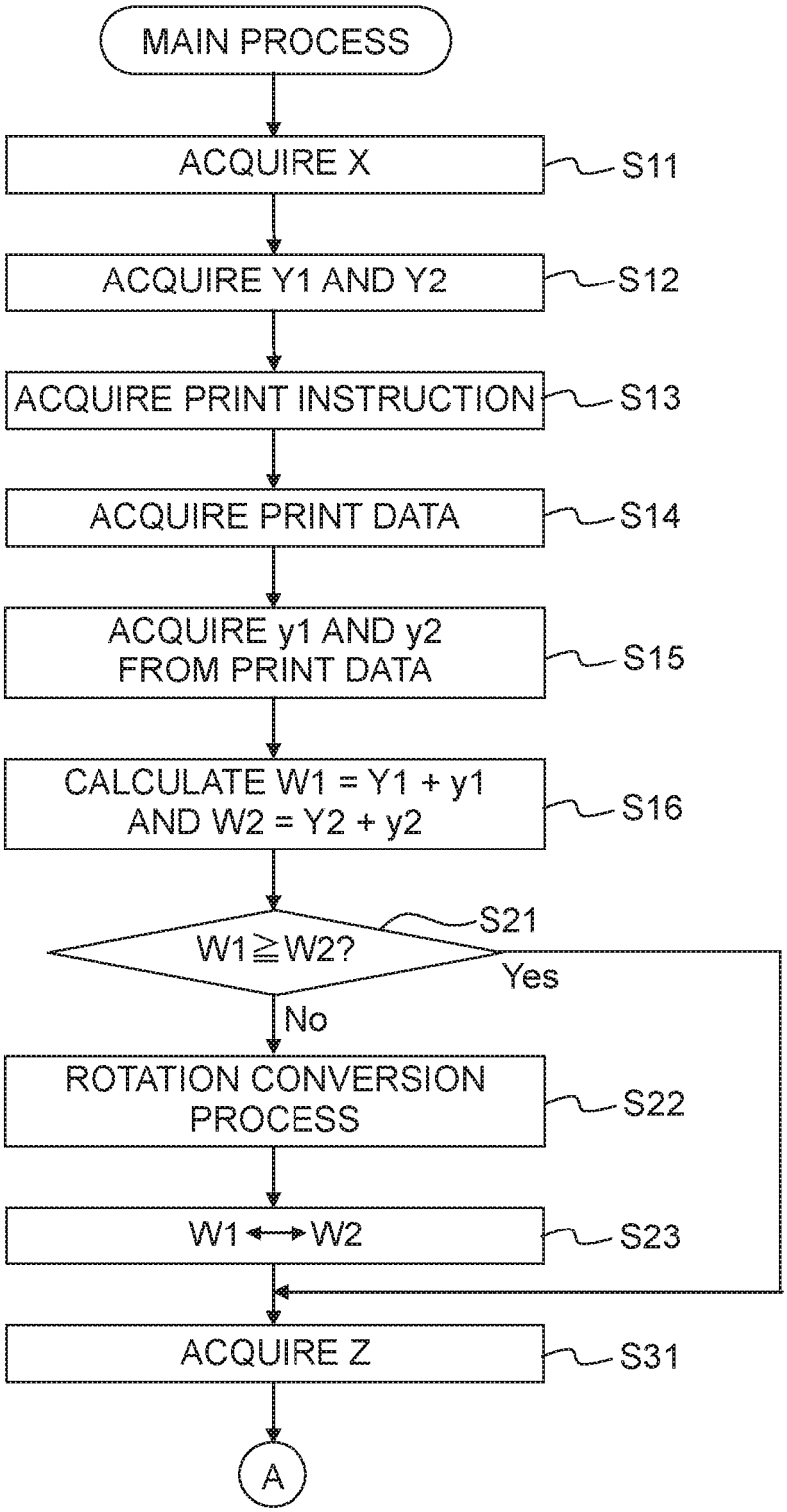
FIGS. 7A and 7B are a flowchart of a main process.
Figure 7B:
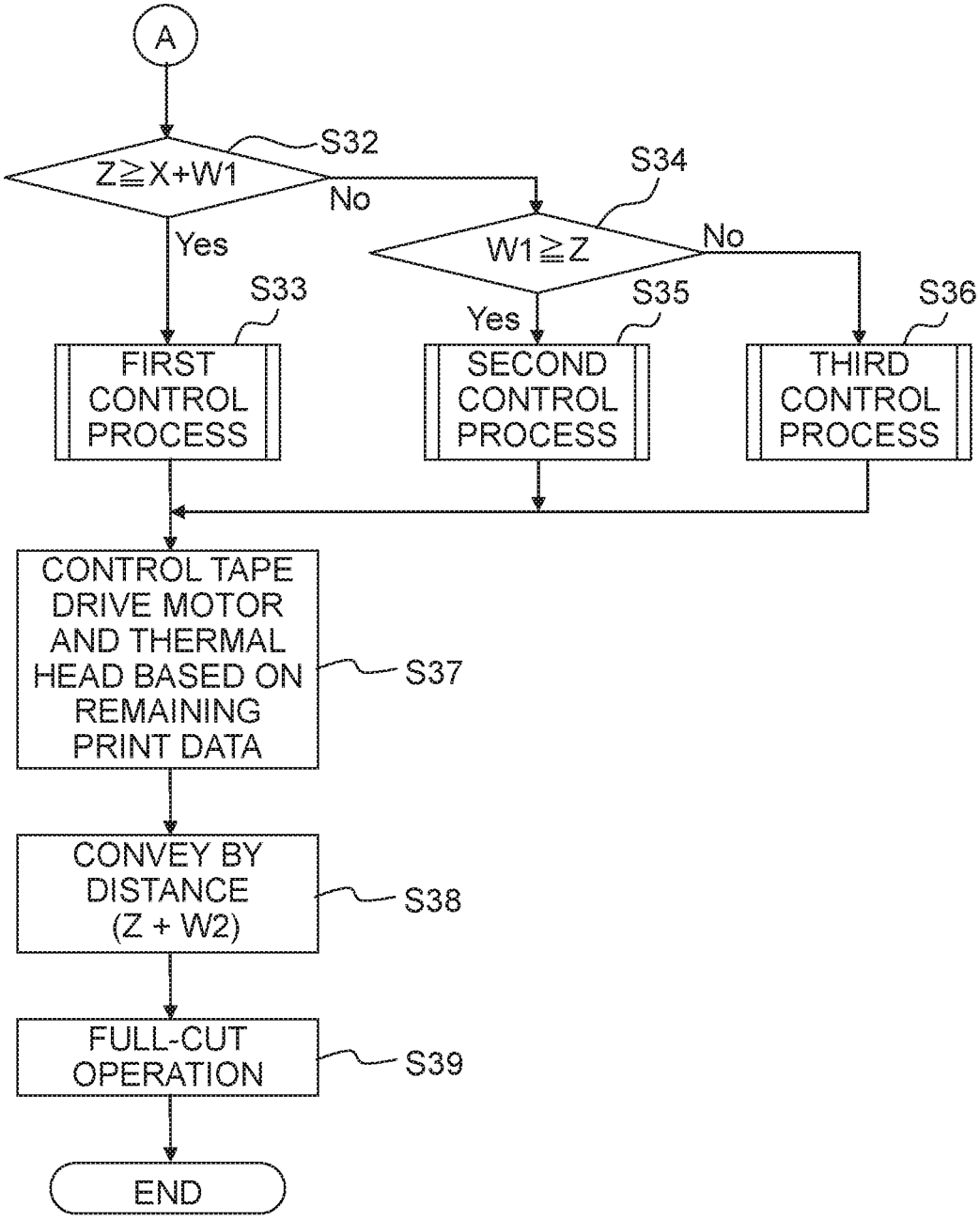

As depicted in FIGS. 7A and 7B, the user operates the input unit 3 to input the specified length X to the CPU 21. The CPU 21 acquires the specified length X inputted by the user (S11). The RAM 24 stores the acquired specified length X. The user operates the input unit 3 to input the first margin length Y1 and the second margin length Y2 to the CPU 21. The CPU 21 acquires the first margin length Y1 and the second margin length Y2 inputted by the user, respectively (S12). The RAM 24 stores the acquired first margin length Y1 and second margin length Y2, respectively.

The user operates the input unit 3 to input a print instruction to the CPU 21. The CPU 21 acquires the print instruction inputted by the user (S13). The CPU 21 acquires, from the flash memory 25, the print data designated by the print instruction (S14). The RAM 24 stores the acquired print data.

The CPU 21 acquires, from the acquired print data, the first blank length y1 and the second blank length y2, respectively (S15). The RAM 24 stores the acquired first blank length y1 and second blank length y2, respectively. Based on the Y1, y1, Y2, and y2 stored respectively in the RAM 24, the CPU 21 calculates the third total length W1 and the fourth total length W2, respectively (S16). The RAM 24 stores the calculated third total length W1 and fourth total length W2, respectively.

Referring to the RAM 24, the CPU 21 determines whether W1≥W2 (S21). If W1≥W2 (S21: Yes), then the CPU 21 acquires the separation distance Z from the ROM 22 (S31). The RAM 24 stores the acquired separation distance Z. Referring to the RAM 24, the CPU 21 determines whether Z≥(X+W1) (S32). If Z≥(X+W1) (S32: Yes), then the CPU 21 executes a first control process (S33), and then executes the process of S37. If Z<(X+W1) (S32: No), then the CPU 21 determines whether W1≥Z (S34). If W1≥Z (S34: Yes), then the CPU 21 executes a second control process (S35), and then executes the process of S37. If W1<Z (S34: No), then the CPU 21 executes a third control process (S36), and then executes the process of S37.

Figure 8:
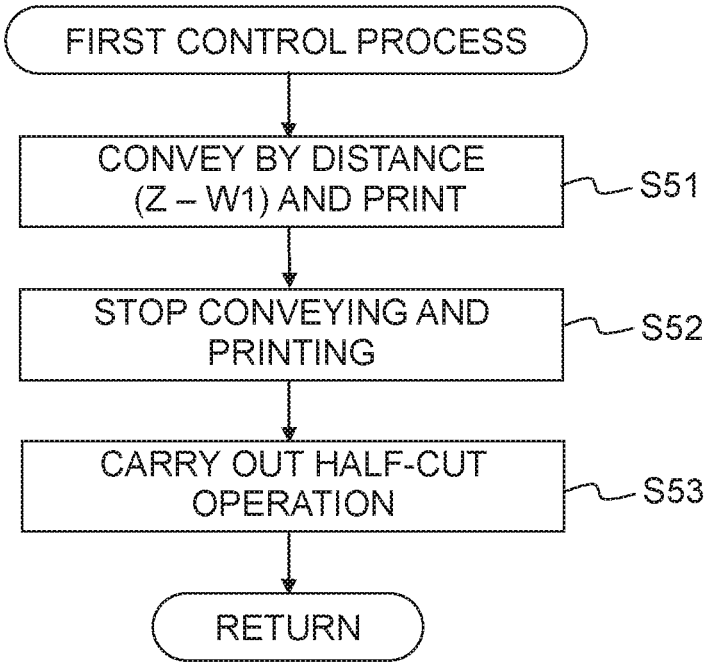
FIG. 8 is a flowchart of the first control process.

Referring to FIGS. 6 and 8, the first control process will be explained. FIG. 6 depicts a state transition of the print tape 37 when W1≥W2 and Z≥X+W1 are satisfied. A state A1 depicts the initial state (much the same is true on a state B1 in FIG. 9, a state C1 in FIG. 11, and a state C11 in FIG. 13). In the initial state, the downstream end of the print tape 37 according to the conveying direction is positioned at the cutting position T2 in the conveying direction. The CPU 21 starts to drive the tape drive motor 18 via the drive circuit 27 to move or convey the print tape 37 by the second differential length (Z−W1) (S51). The CPU 21 starts to drive the thermal head 10 via the drive circuit 26 (S51). By virtue of this, synchronized with the conveyance of the print tape 37, the character line 51 depicting "ABC" is printed on the print surface 38A (that is, the part of the print image 50 excluding the first blank area 52 and the second blank area 53). If the print tape 37 is conveyed by the second differential length (Z−W1) while being printed thereon, then the print tape 37 transits from the state A1 to the state A2, and hence the CPU 21 stops driving the tape drive motor 18 via the drive circuit 27 (S52). The CPU 21 stops driving the thermal head 10 via the drive circuit 26 (S52).

The CPU 21 executes the half-cut operation by driving the cutter drive motor 19 to rotate forward via the drive circuit 28 (S53). In the state depicted by A2, the non-print end portion 37A is formed to have the second differential length (Z−W1) along the conveying direction. The CPU 21 returns the process to the main process (see FIGS. 7A and 7B).

Figure 9:
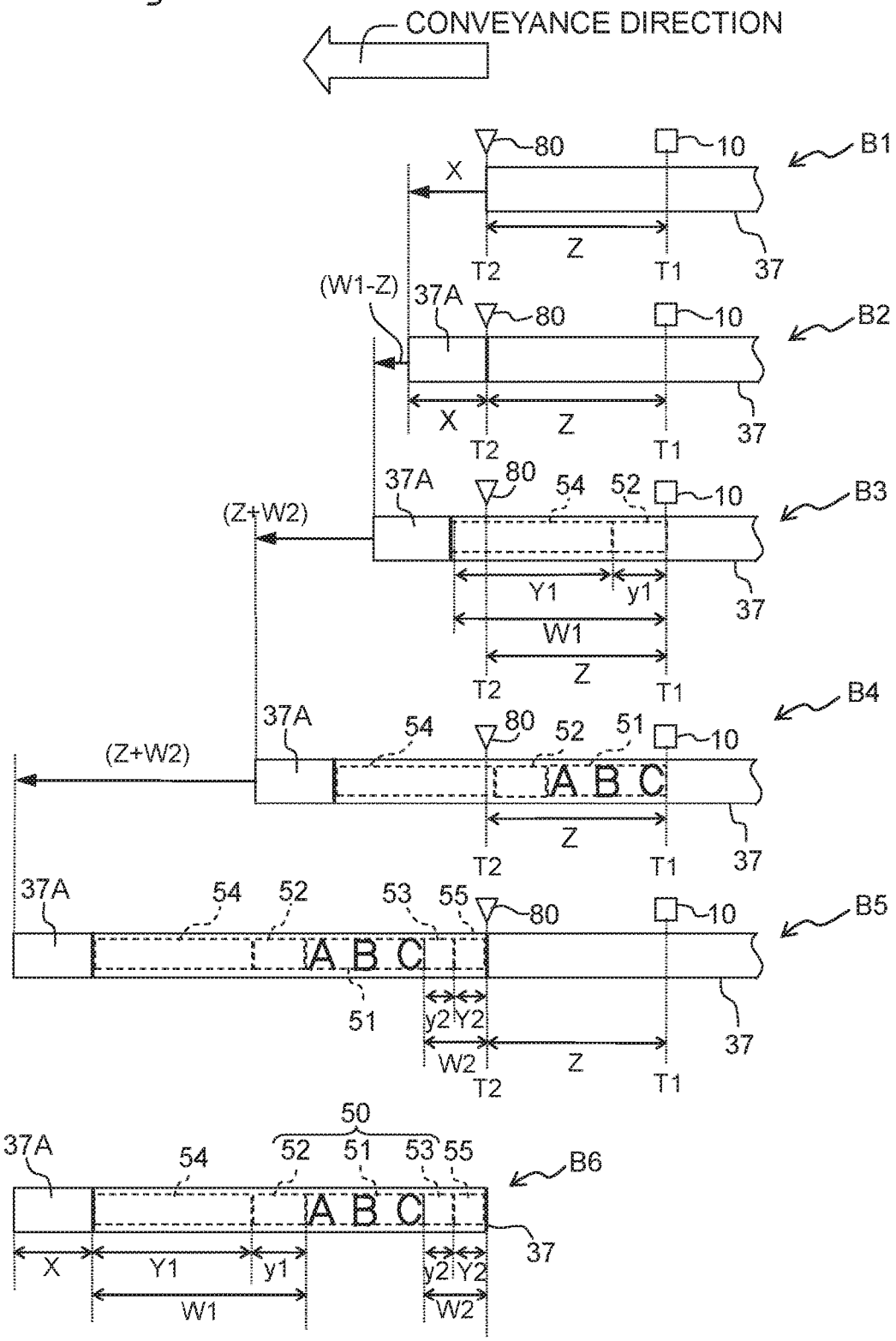
FIG. 9 is a state transition diagram of the print tape when a second control process is carried out.
Figure 10:
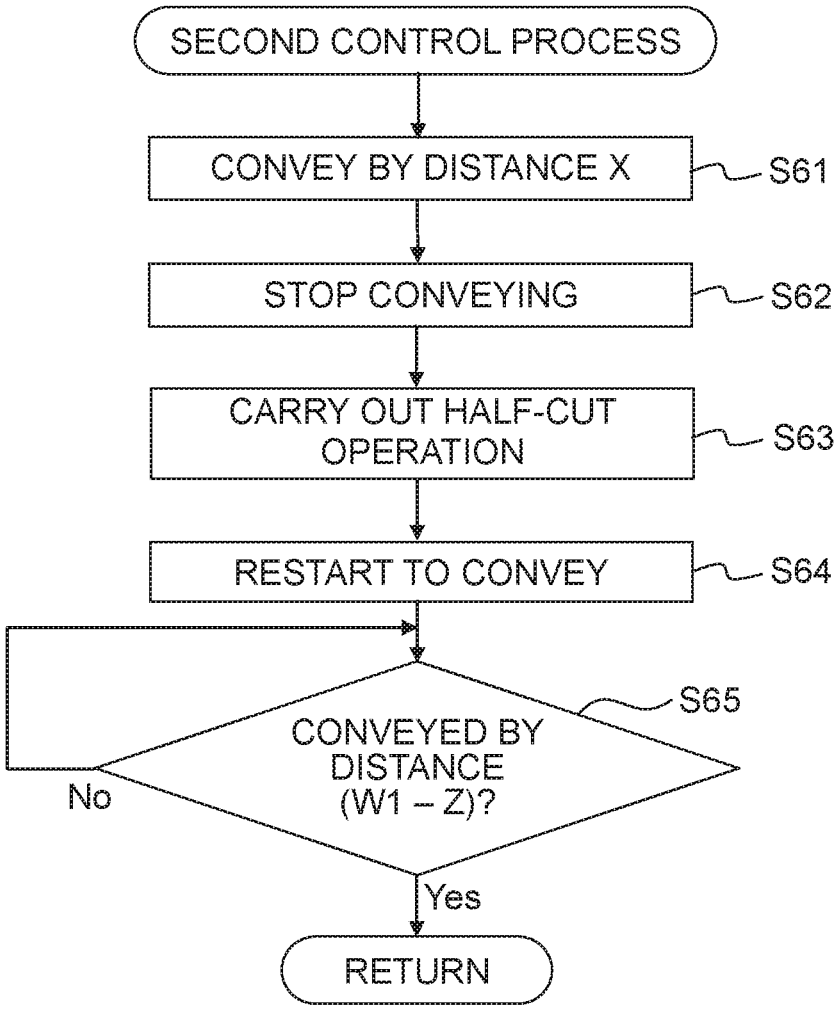
FIG. 10 is a flowchart of the second control process.

Referring to FIGS. 9 and 10, the second control process will be explained. FIG. 9 depicts a state transition of the print tape 37 when W1≥W2, Z<X+W1, and W1≥Z are satisfied. The CPU 21 starts to drive the tape drive motor 18 via the drive circuit 27 to convey the print tape 37 by the specified length X (S61). If the print tape 37 is conveyed by the specified length X, then the print tape 37 transits from the state B1 to the state B2, and hence the CPU 21 stops driving the tape drive motor 18 via the drive circuit 27 (S62). The CPU 21 executes the half-cut operation by driving the cutter drive motor 19 to rotate forward via the drive circuit 28 (S63). In the state depicted by B2, the non-print end portion 37A is formed to have the specified length X along the conveying direction.

The CPU 21 restarts driving the tape drive motor 18 via the drive circuit 27 to convey the print tape 37 (S64). The CPU 21 determines whether the print tape 37 is conveyed by the second differential length (W1−Z) (S65). If the print tape 37 is not conveyed by the second differential length (W1−Z) (S65: No), then the CPU 21 repeats S65 until the print tape 37 is conveyed by the second differential length (W1−Z). If the print tape 37 is conveyed by the second differential length (W1−Z) (S65: Yes), then the print tape 37 transits from the state B2 to the state B3, and hence the CPU 21 returns the process to the main process (see FIGS. 7A and 7B).

Figure 11:
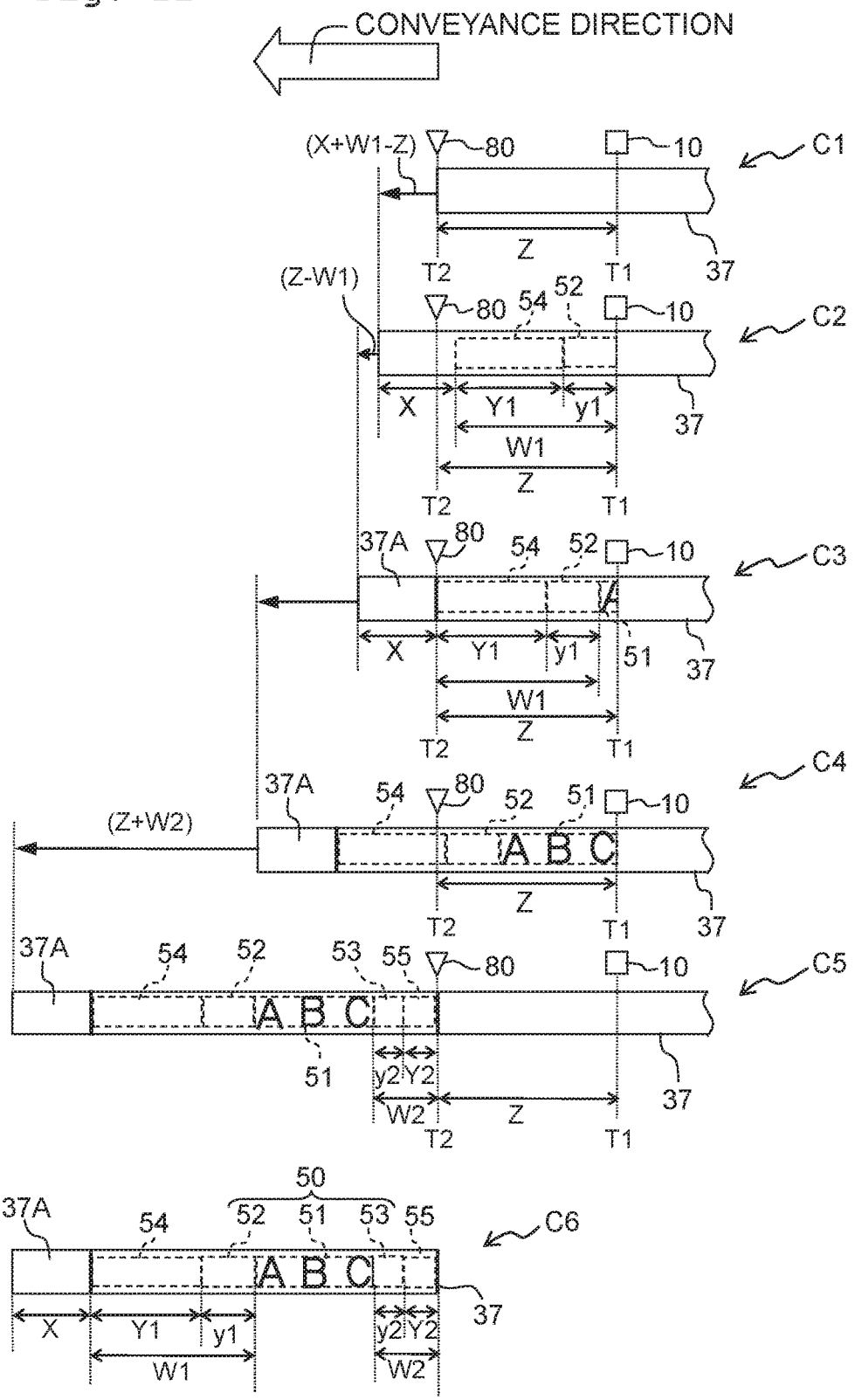
FIG. 11 is a state transition diagram of the print tape when a third control process is carried out.
Figure 12:
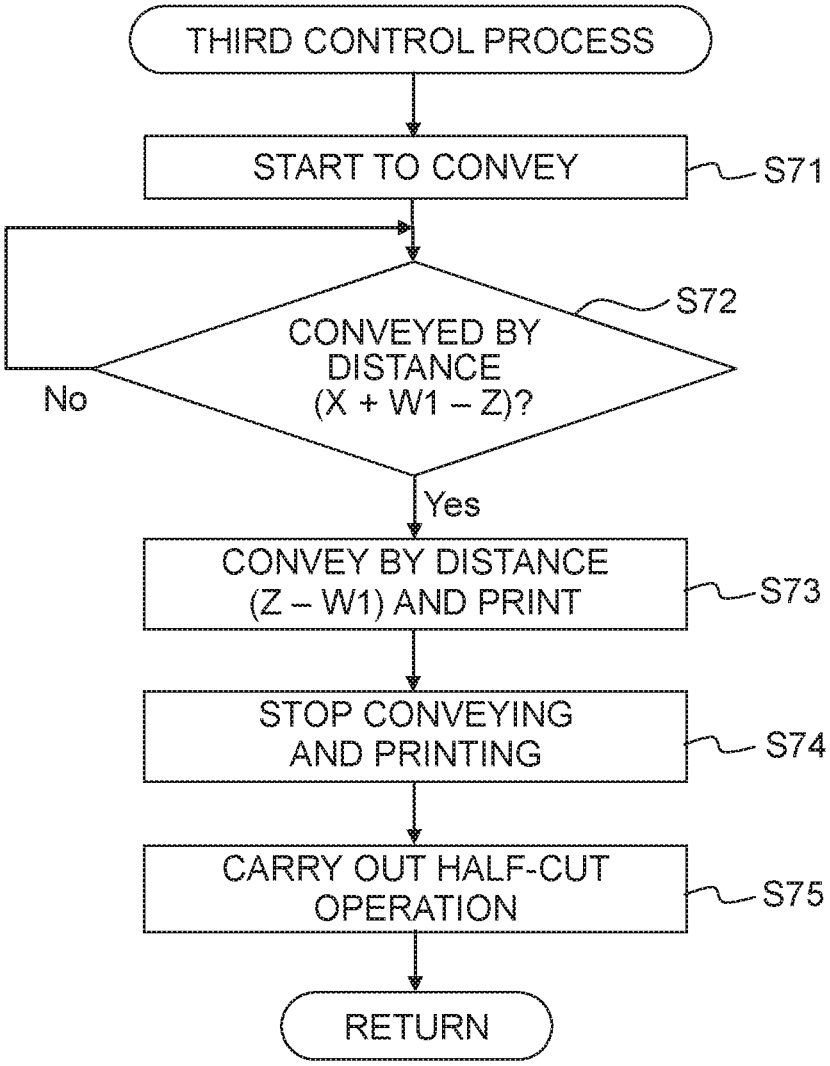
FIG. 12 is a flowchart of the third control process.

Referring to FIGS. 11 and 12, the third control process will be explained. FIG. 11 depicts a state transition of the print tape 37 when W1≥W2, Z<X+W1, and W1<Z are satisfied. The CPU 21 starts to drive the tape drive motor 18 via the drive circuit 27 to convey the print tape 37 (S71). The CPU 21 determines whether the print tape 37 is conveyed by the third differential length (X+W1−Z) (S72). If the print tape 37 is not conveyed by the third differential length (X+W1−Z) (S72: No), then the CPU 21 repeats S27 until the print tape 37 is conveyed by the third differential length (X+W1−Z). If the print tape 37 is conveyed by the third differential length (X+W1−Z) (S72: Yes), then the print tape 37 transits from the state C1 to the state C2, and hence the CPU 21 starts to drive the thermal head 10 via the drive circuit 26 (S73). By virtue of this, synchronized with the conveyance of the print tape 37, the character line 51 showing "ABC" is printed on the print surface 38A. The CPU 21 keeps controlling the driving of the tape drive motor 18 via the drive circuit 27 to convey the print tape 37 by the second differential length (Z−W1) (S73). If the print tape 37 is conveyed by the second differential length (Z−W1) while being printed thereon, then the print tape 37 transits from the state C2 to the state C3, and hence the CPU 21 stops driving the tape drive motor 18 via the drive circuit 27 (S74). The CPU 21 stops driving the thermal head 10 via the drive circuit 26 (S74).

The CPU 21 executes the half-cut operation by driving the cutter drive motor 19 to rotate forward via the drive circuit 28 (S75). In the state depicted by C3, the non-print end portion 37A is formed to have the specified length X in the conveying direction. The CPU 21 returns the process to the main process (see FIGS. 7A and 7B).

As depicted in FIGS. 7A and 7B, after the aforementioned first control process (see FIG. 8), second control process (see FIG. 10), and third control process (see FIG. 12), based on the print data remaining unprocessed, the CPU 21 controls the tape drive motor 18 and the thermal head 10 (S37). By virtue of this, synchronized with the conveyance of the print tape 37, such a part of the character line 51 showing "ABC" is printed on the print surface 38A as not printed in the first control process, second control process, and third control process. If printing the character line 51 showing "ABC" is finished and the conveyance is stopped, then in the case of FIG. 6, the print tape 37 transits from the state A2 to the state A3. In the case of FIG. 9, the print tape 37 transits from the state B3 to the state B4. In the case of FIG. 11, the print tape 37 transits from the state C3 to the state C4.

The CPU 21 controls the tape drive motor 18 via the drive circuit 27 to convey the print tape 37 by the fifth total length (Z+W2) (S38). If the print tape 37 is conveyed by the fifth total length (Z+W2), then the CPU 21 stops driving the tape drive motor 18 via the drive circuit 27 (S38). In the case of FIG. 6, the print tape 37 transits from the state A3 to the state A4. In the case of FIG. 9, the print tape 37 transits from the state B4 to the state B5. In the case of FIG. 11, the print tape 37 transits from the state C4 to the state C5. The CPU 21 executes the full-cut operation by driving the cutter drive motor 19 to rotate reversely via the drive circuit 28 (S39). In the case of FIG. 6, the print tape 37 in the state depicted by A5 is provided as the printed result to the user. In the case of FIG. 9, the print tape 37 in the state depicted by B6 is provided as the printed result to the user. In the case of FIG. 11, the print tape 37 in the state depicted by C6 is provided as the printed result to the user. Then, the CPU 21 ends the main process.

In S21, if W1<W2 (S21: No), then the CPU 21 executes a rotation conversion process (S22). In the rotation conversion process, the print data acquired in S13 are converted into new print data for printing the print image 50 (see FIG. 13) rotated by 180 degrees.

The CPU 21 interchanges the third total length W1 and the fourth total length W2 (S23). In detail, the third total length W1 stored in the RAM 24 is newly updated as the fourth total length w2, and the fourth total length W2 before being updated is newly updated as the third total length W1. Based on the interchanged third total length W1 and the new print data after the rotation conversion process, the CPU 21 executes the process from S31. For example, in S32 and S34, the determination is made based on the interchanged third total length W1 (that is, the fourth total length W2 before being interchanged).

Figure 13:
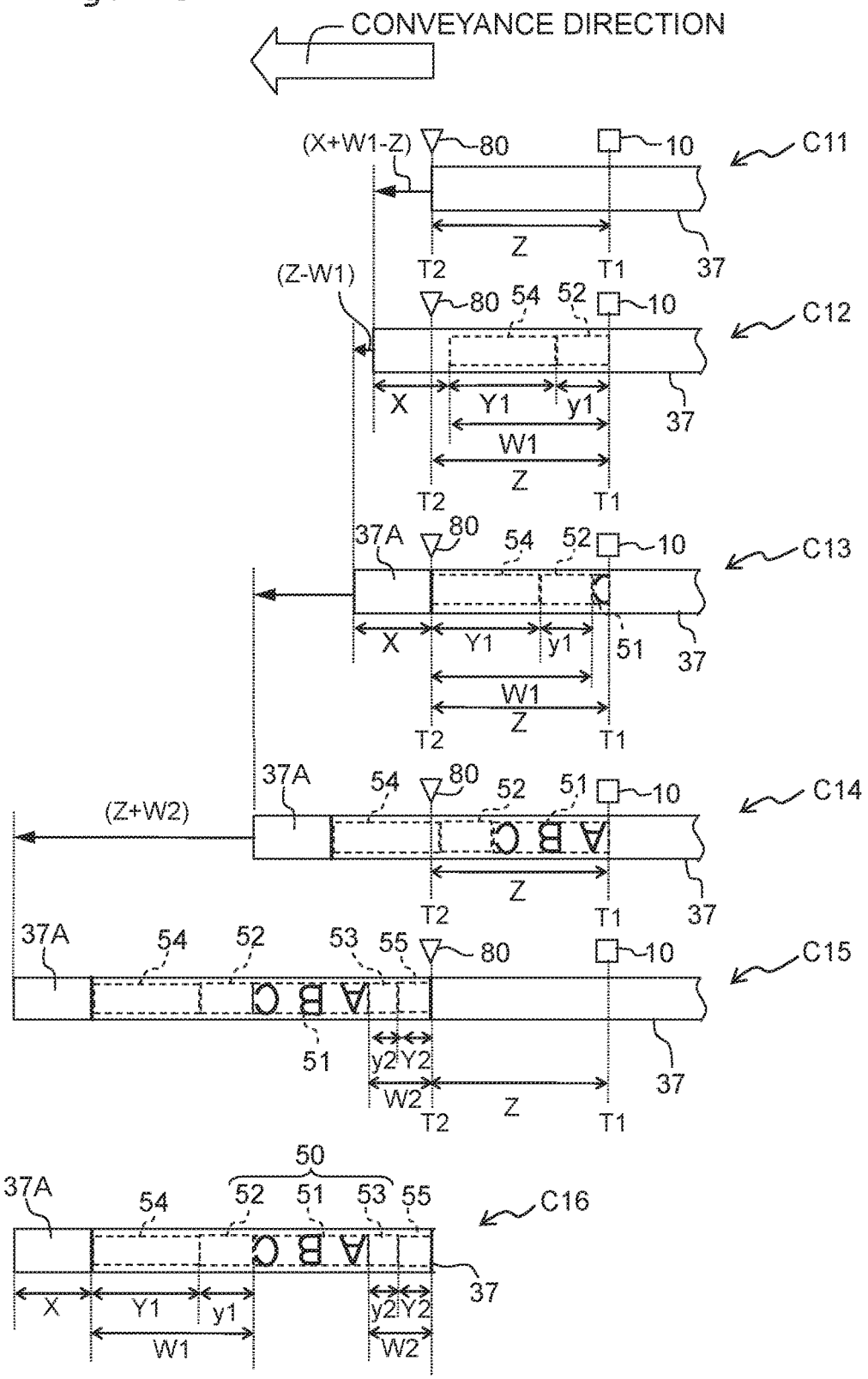
FIG. 13 is a state transition diagram of the print tape in the third control process when a rotation conversion process is carried out.

FIG. 13 depicts a transition state of the print tape 37, as an example, when the third control process (see FIG. 12) is executed after the rotation conversion process (S22). The CPU 21 executes the third control process based on the interchanged third total length W1 and the new print data after the rotation conversion process. The state C11 to the state C16 correspond respectively to the state C1 to the state C6 (see FIG. 11). If S22 and S23 are executed, then the print tape 37 in the state depicted by C16 is provided as the printed result to the user. The state depicted by C16 represents the print tape 37 printed with the print image 50 rotated by 180 degrees.

As explained above, if the separation distance Z is the second total length (X+W1) or longer, then the second differential length (Z−W1) is secured as the non-print end portion 37A. If the separation distance Z is shorter than the second total length (X+W1), then the specified length X is secured as the non-print end portion 37A. The second differential length (Z−W1) is the specified length X or longer. Therefore, it is possible for the printing apparatus 1 to secure at least the specified length X or at most second differential length (Z−W1) as the non-print end portion 37A, according to the separation distance Z, the specified length X, and the first margin length Y1. For example, the user can handle the printed print tape 37 while holding the non-print end portion 37A where at least the specified length X is secured. Hence, the printing apparatus 1 can lessen the size of the non-print end portion 37A while securing the ease for the user to handle the print tape 37. The second differential length (Z−W1) is the first differential length (Z−Y1) or shorter in the aftermentioned first modification. Hence, if the separation distance Z is the second total length (X+W1) or longer, then the printing apparatus 1 can further lessen the size of the non-print end portion 37A while securing the ease for the user to handle the print tape 37, compared with the first modification.

Because the printing apparatus 1 includes the input unit 3, the user can operate the input unit 3 to input the specified length X. Therefore, according to the user's purpose, the printing apparatus 1 can acquire at least the length (the specified length X) secured as the length of the non-print end portion 37A along the conveying direction.

If the third total length W1 is shorter than the fourth total length W2, then the acquired print data are converted into the new print data for printing the print image 50 rotated by 180 degrees. The third total length W1 and the fourth total length W2 are interchanged to control the printing and the like. Because the third total length W1 is shorter than the fourth total length W2, after the interchange, the third total length W1 becomes longer than the fourth total length W2. Hence, compared with the case where the third total length W1 and the fourth total length W2 are not interchanged, it is easier to determine the separation distance Z is shorter than the second total length (X+W1). Therefore, even if the third total length W1 is short, for example, the printing apparatus 1 can still lessen the size of the non-print end portion 37A while securing the ease for the user to handle the print tape 37 when the fourth total length W2 is long.

The separation distance Z is the distance along the conveyance path L between the printing position T1 and the cutting position T2. The length of the print tape 37 on the conveyance path L between the printing position T1 and the cutting position T2 is more stabilized than when the print tape 37 is conveyed, for example, after being cut up. Therefore, because it is easy for the separation distance Z to consist with the length of the print tape 37 on the conveyance path L between the printing position T1 and the cutting position T2, the printing apparatus 1 can control the conveying, printing and cutting with high precision.

In this embodiment, the tape drive roller 46 corresponds to the "conveyor" of the present teaching. The printing position T1 corresponds to the "first position" of the present teaching. The thermal head 10 corresponds to the "print head" of the present teaching. The cutting position T2 corresponds to the "second position" and the "third position" of the present teaching. The cutting mechanism 80 corresponds to the "cutter" of the present teaching.

The processes of S51 and S52 of FIG. 8 correspond to the "first process" of the present teaching. The process of S53 of FIG. 8 corresponds to the "second process" of the present teaching. The process of S37 of FIG. 7B corresponds to the "third process" of the present teaching. The processes of S61 and S62 of FIG. 10 correspond to the "fourth process" of the present teaching. The process of S63 of FIG. 10 corresponds to the "fifth process" of the present teaching. The process of S64 of FIG. 10 corresponds to the "sixth process" of the present teaching. The processes of S65 of FIG. 10 and S37 of FIG. 7B correspond to the "seventh process" of the present teaching. The process of S71 of FIG. 12 corresponds to the "eighth process" of the present teaching. The processes of S72, S73 and S74 of FIG. 12 correspond to the "ninth process" of the present teaching. The process of S75 of FIG. 12 corresponds to the "tenth process" of the present teaching. The process of S37 of FIG. 7B corresponds to the "eleventh process" of the present teaching.

It is possible to apply various changes and modifications to the present teaching in the above embodiment. For example, in the main process (see FIGS. 7A and 7B) of the above embodiment, S15 and S16 may be omitted as in the first modification which will be explained below. Referring to FIGS. 14 to 17, the first modification will be explained. Further, to the processes corresponding to those in the above embodiment (see FIGS. 7, 8, 10, and 12), the same step numbers are assigned, and the explanation will be made mainly for different aspects.

Figure 14A:
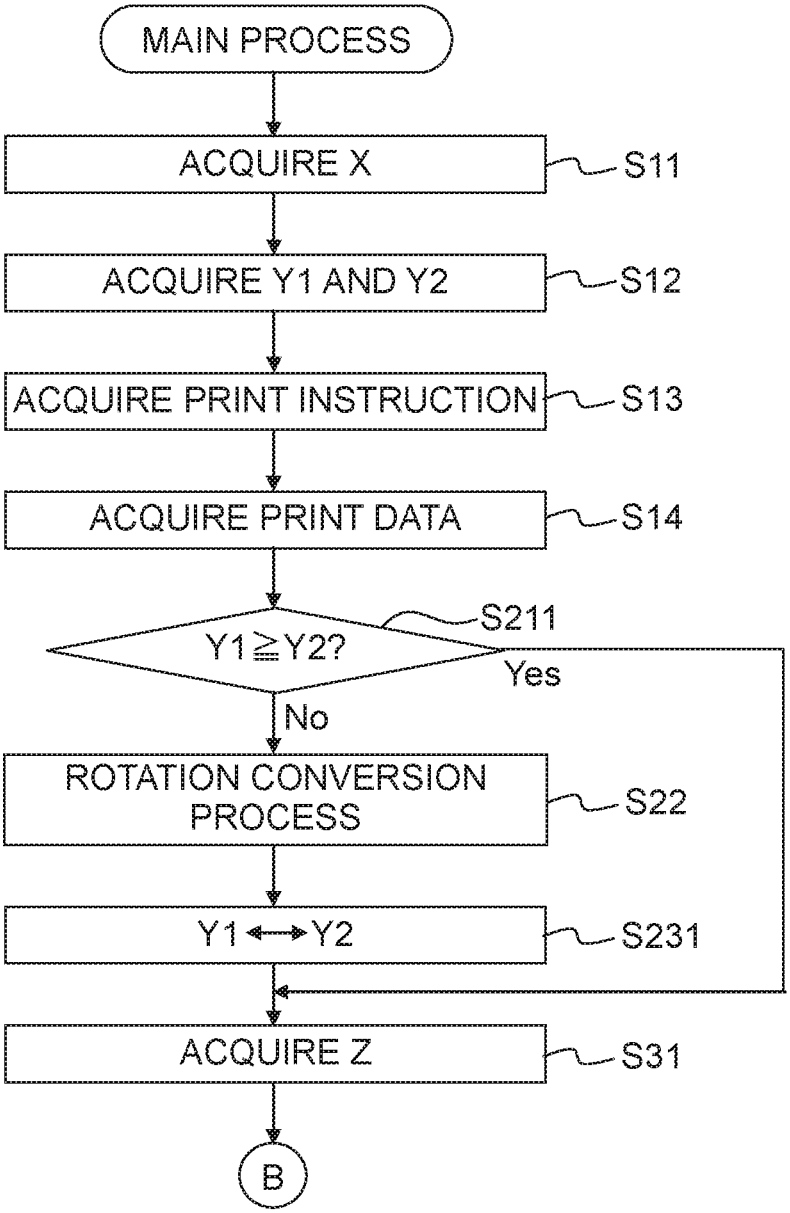
FIGS. 14A and 14B are a flowchart of a main process according to a first modification.
Figure 14B:
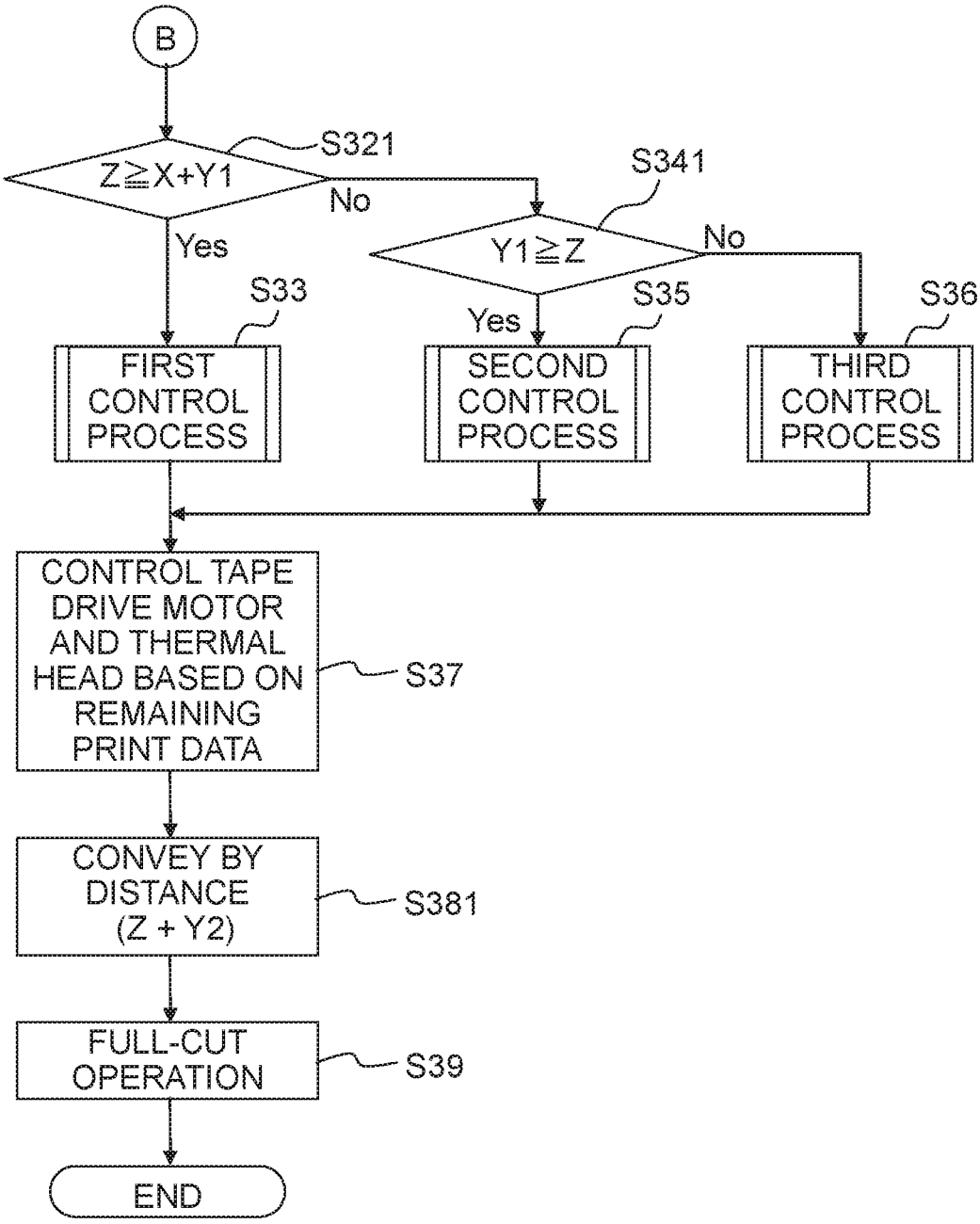

As depicted in FIGS. 14A and 14B, in the main process of the first modification, after acquiring print data from the flash memory 25 (S14), the CPU 21 determines whether Y1≥Y2 instead of S21 (S211). If Y1<Y2 (S211: No), then the CPU 21 executes the rotation conversion process (S22). Instead of S23, the CPU 21 interchanges the first margin length Y1 and the second margin length Y2 (S231), and executes the process of S31. If Y1≥Y2 (S211: Yes), then the CPU 21 executes the process of S31.

After acquiring the separation distance Z from the ROM 22 (S31), instead of S32, referring to the RAM 24, the CPU 21 determines whether Z≥(X+Y1) (S321). If Z≥(X+Y1) (S321: Yes), then the CPU 21 executes the first control process (S33). If Z<(X+Y1) (S321: No), then instead of S34, the CPU 21 determines whether Y1≥Z (S341). If Y1≥Z (S341: Yes), then the CPU 21 executes the second control process (S35). If Y1<Z (S341: No), then the CPU 21 executes the third control process (S36).

Figure 15:
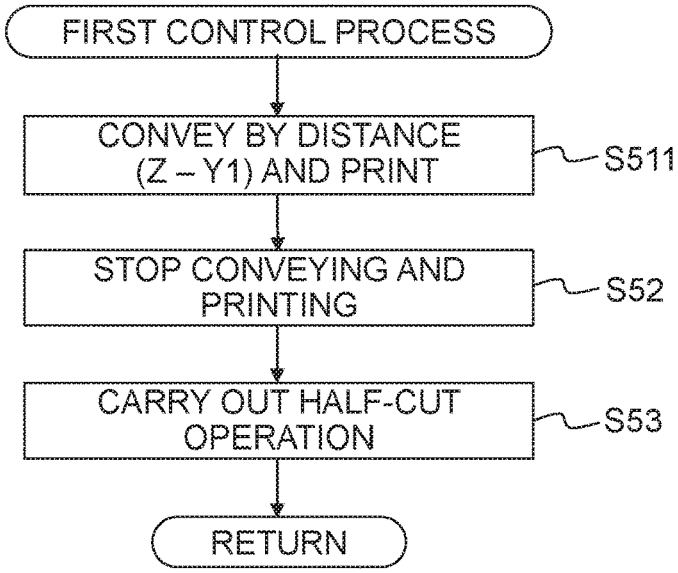
FIG. 15 is a flowchart of a first control process according to the first modification.

As depicted in FIG. 15, in the first control process of the first modification, instead of S51, the CPU 21 starts to drive the tape drive motor 18 via the drive circuit 27 to convey the print tape 37 by the first differential length (Z−Y1) (S511). The CPU 21 starts to drive the thermal head 10 via the drive circuit 26 (S511). The CPU 21 executes the process from S52. By virtue of this, synchronized with the conveyance of the print tape 37, based on the image data, printing is executed on the print surface 38A.

Figure 16:
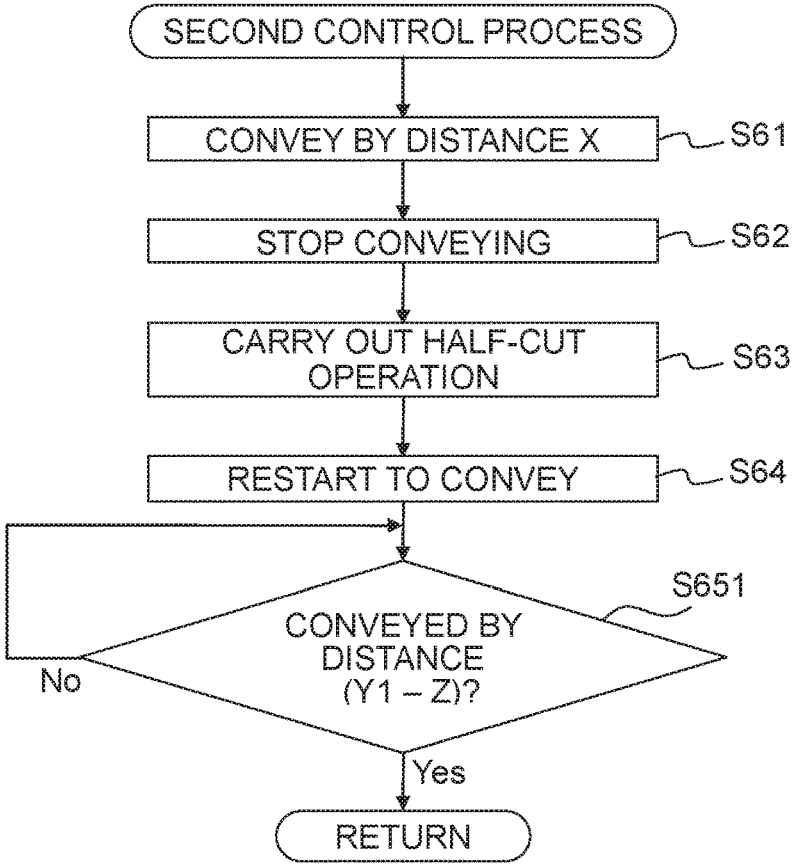
FIG. 16 is a flowchart of a second control process according to the first modification.

As depicted in FIG. 16, in the second control process of the first modification, after the CPU 21 restarts driving the tape drive motor 18 via the drive circuit 27 (S64), instead of S65, the CPU 21 determines whether the print tape 37 is conveyed by the first differential length (Y1−Z) (S651). If the print tape 37 is not conveyed by the first differential length (Y1−Z) (S651: No), then the CPU 21 repeats S651 until the print tape 37 is conveyed by the first differential length (Y1−Z). If the print tape 37 is conveyed by the first differential length (Y1−Z) (S651: Yes), then the CPU 21 returns the process to the main process of the first modification (see FIGS. 14A and 14B).

Figure 17:
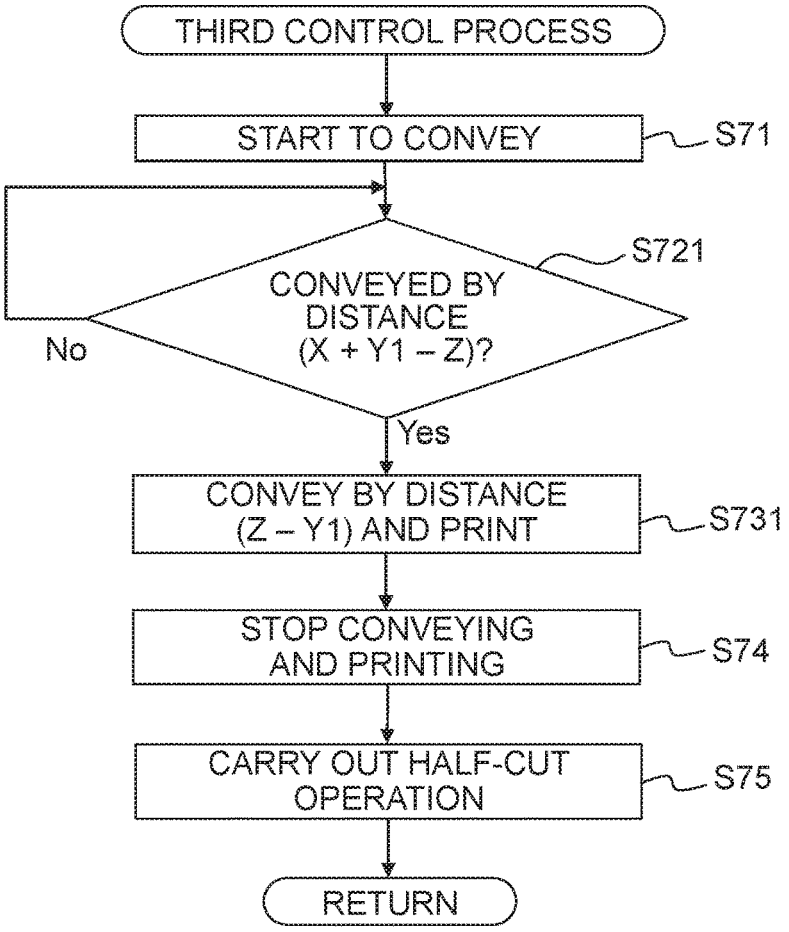
FIG. 17 is a flowchart of a third control process according to the first modification.

As depicted in FIG. 17, in the third control process of the first modification, after the CPU 21 starts to drive the tape drive motor 18 via the drive circuit 27 (S71), instead of S72, the CPU 21 determines whether the print tape 37 is conveyed by the fourth differential length (X+Y1−Z) (S721). If the print tape 37 is not conveyed by the fourth differential length (X+Y1−Z) (S721: No), then the CPU 21 repeats S721 until the print tape 37 is conveyed by the fourth differential length (X+Y1−Z). If the print tape 37 is conveyed by the fourth differential length (X+Y1−Z) (S721: Yes), then instead of S73, the CPU 21 starts to drive the thermal head 10 via the drive circuit 27 (S731). The CPU 21 keeps controlling the tape drive motor 18 via the drive circuit 27 to convey the print tape 37 by the first differential length (Z−Y1) (S731). The CPU 21 executes the process from S74.

If the separation distance Z is the first total length (X+Y1) or longer, then the first differential length (Z−Y1) is secured as the non-print end portion 37A. If the separation distance Z is shorter than the first total length (X+Y1), then the specified length X is secured as the non-print end portion 37A. The first differential length (Z−Y1) is the specified length X or longer. Hence, the printing apparatus 1 can secure at least the specified length X or at most the first differential length (Z−Y1) as the non-print end portion 37A, according to the separation distance Z, the specified length X, and the first margin length Y1. Therefore, the printing apparatus 1 can lessen the size of the non-print end portion 37A while securing the ease for the user to handle the print tape 37.

Figure 18:
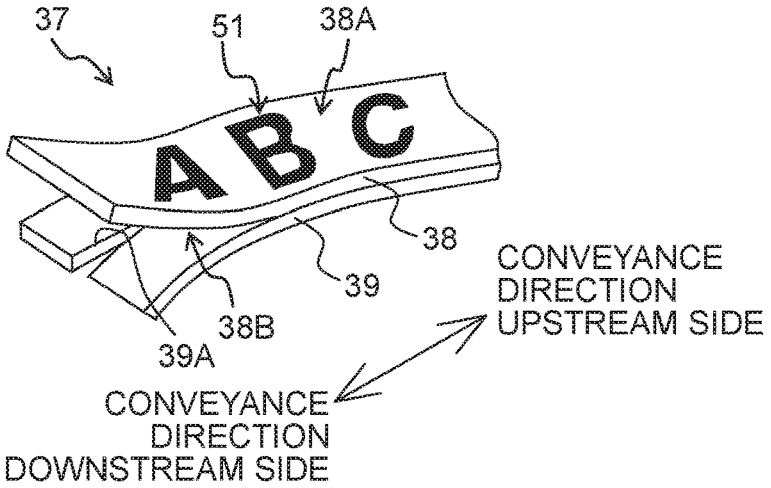
FIG. 18 depicts a specific print tape when the character line is printed thereon to depict "ABC".

Further, as depicted in FIG. 18, for example, the print tape 37 has the type with a longitudinal notch 39A precut in the release paper 39, and the type without the notch 39A in the release paper 39 (see FIG. 3). Hereinbelow, the term "specific print tape 37" will be used to refer to the print tape 37 with the longitudinal notch 39A precut in the release paper 39. If printing is carried out on the specific print tape 37, then the user can make use of the notch 39A, for example, to detach the release paper 39 from the adhesive tape 38. Therefore, the specific print tape 37 may not have the non-print end portion 37A. In this case, for example, as will be explained below in a second modification, the CPU 21 may specify whether or not the type of the print tape 37 is of the specific print tape 37 based on the formation pattern outputted from the switch sensor 13. The CPU 21 may carry out the control for securing the non-print end portion 37A having at least the specified length X (such as in the main process depicted in FIGS. 7A and 7B) only in the case where the type of the print tape 37 is not of the specific print tape 37.

Figure 19A:
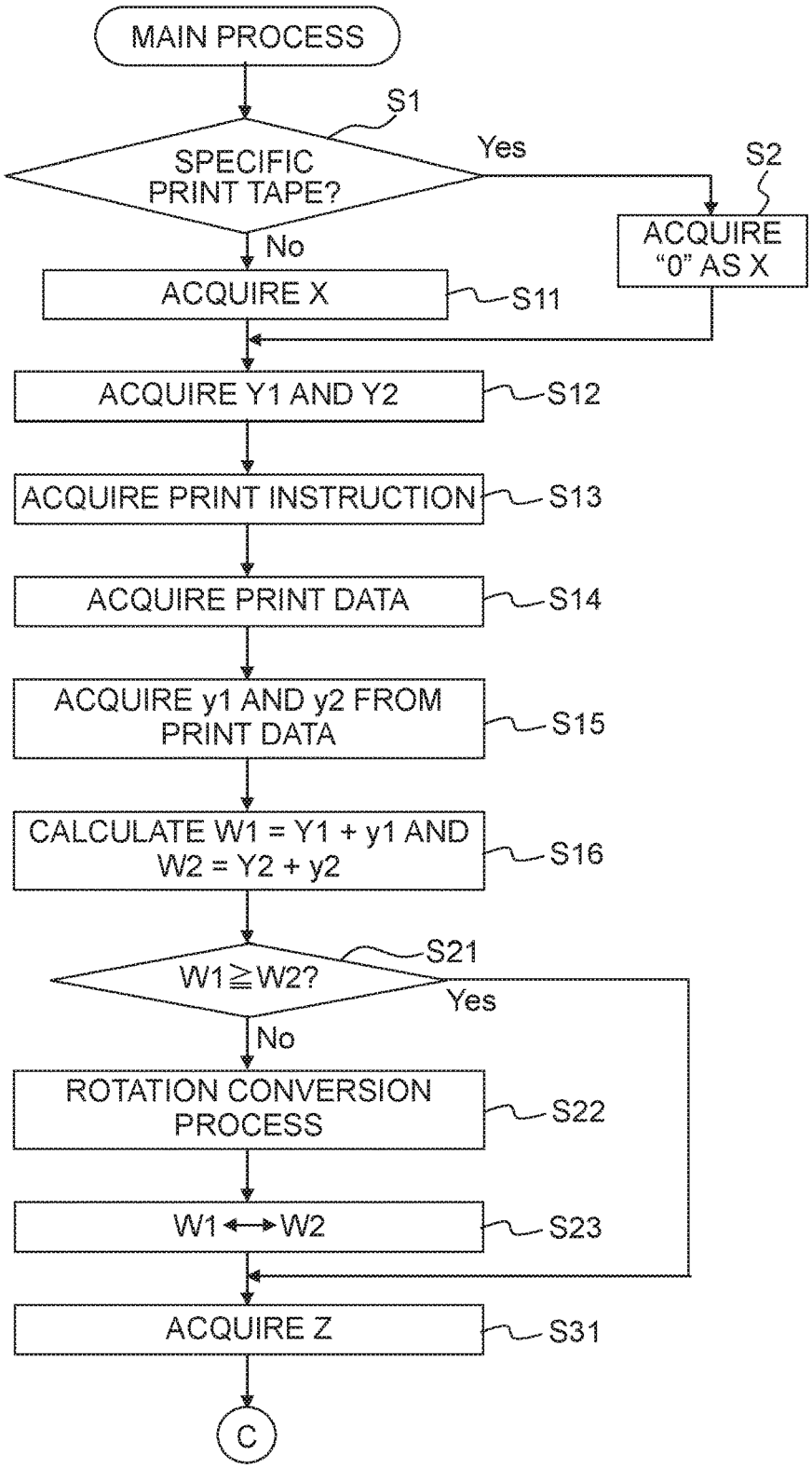
FIGS. 19A and 19B are a flowchart of a main process according to a second modification.
Figure 19B:
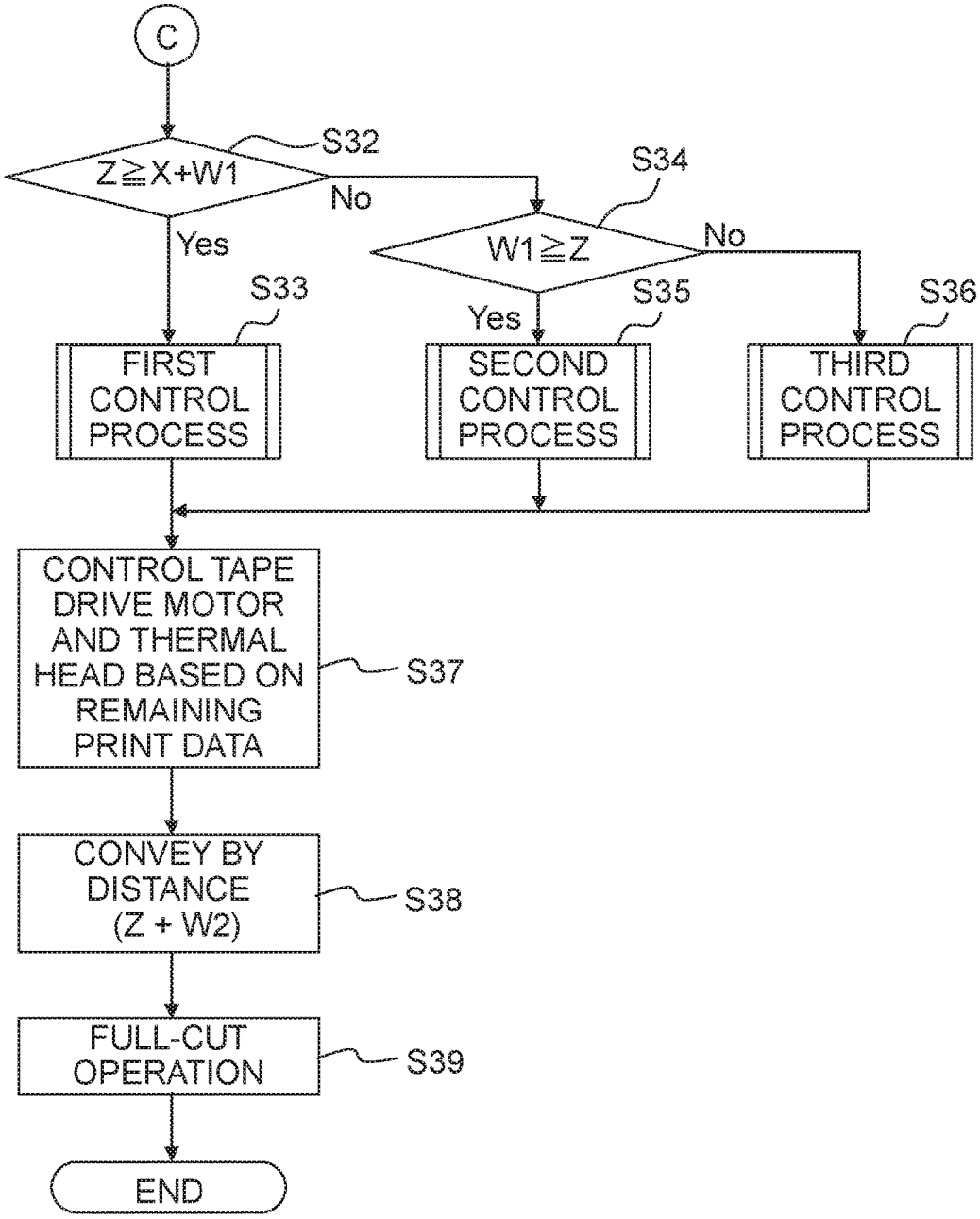

Referring to FIGS. 18, 19A and 19B, the second modification will be explained. Further, the same step numbers are assigned to the processes corresponding respectively to those in the main process (see FIGS. 7A and 7B) of the aforementioned embodiment, and any explanation therefor will be omitted. Descriptions will be made mainly for different aspects. Based on the formation pattern outputted from the switch sensor 13, the CPU 21 determines whether or not the type of the print tape 37 is of the specific print tape 37 (S1). If the type of the print tape 37 is not of the specific print tape 37 (S1: No), then the CPU 21 executes the process from S11 in the same manner as in the aforementioned embodiment. If the type of the print tape 37 is of the specific print tape 37 (S1: Yes), then the CPU 21 acquires "0" as the specified length X (S2). The RAM 24 stores the "0" as the specified length X. The CPU 21 executes the process from S12. Further, if S2 is executed, then because the specified length X is "0", S61 to S63 of the second control process (see FIG. 10), and S74 and S75 of the third control process (see FIG. 12) may be omitted.

If there is no notch 39A in the release paper 39, then it is possible for the user to have difficulty in detaching the release paper 39 from the print tape 37. If the notch 39A is in the release paper 39, then the user can more easily detach the release paper 39 from the print tape 37 by using the notch 39A of the release paper 39, than the case where there is no notch 39A in the release paper 39. If the tape cassette 30 having the specific print tape 37 is installed in the installation portion 8 in the printing apparatus 1, then the specified length X is set to the "0". Hence, the non-print end portion 37A becomes small. In particular, after S2 is executed, if the first control process (S33) is executed, then the non-print end portion 37A having the second differential length (Z−W1) is formed. That is, it is possible to obtain the same printed result as in the aforementioned embodiment when the first control process is executed. After S2 is executed, if the second control process (s35) is executed, then because the specified length X is the "0", the non-print end portion 37A is not formed. After S2 is executed, if the third control process (S36) is executed, then because the specified length X is the "0", the non-print end portion 37A is not formed. In this manner, the printing apparatus 1 determines whether or not to secure at least the specified length X as the non-print end portion 37A according to whether or not the notch 39A is formed beforehand in the release paper 39 for detaching the release paper 39 easily.

In the second modification, if S2 is executed, then the half-cut operation is carried out in S53 of the first control process (see FIG. 8). However, when S2 is executed, the full-cut operation may be carried out instead. In particular, the CPU 21 may carry out a flag process after S2. Referring to a flag, the CPU 21 may carry out the full-cut operation in S53 if it is determined that S2 was executed, but carry out the half-cut operation in S53 if it is determined that S11 was executed.

In the second modification, the method of detecting the type of the print tape 37 is not limited to using the switch sensor 13. For example, the user may operate the input unit 3 in advance to input the type of the print tape 37 to the CPU 21.

It is possible to apply other modifications to the present teaching than the above first modification and second modification. For example, the CPU 21 may omit carrying out S21 to S23. The CPU 21 may omit carrying out S38 and S39. In such cases, after the printing is finished, the user may draw out the tape and cup up the same. If the user cuts up the tape manually, then the cutting mechanism 80 may not include the full-cut mechanism 85.

In the aforementioned embodiment, the tape cassette 30 is adopted to fit a tape of the receptor type. However, the present teaching is applicable to the tape cassette 30 fitting a tape of the laminate type, tube type, or the like.

In the aforementioned embodiment, the tape may be single-layered. In the aforementioned embodiment, the half-cut mechanism 81 cuts up a part of the layers of the printed tape. In contrast to this, the half-cut mechanism 81 may form a dash-line notch extending in the width direction of the tape, for example, for all layers of the printed tape. When using the tape cassette 30 fitting a tape of the laminate type, film tapes are applied to the printed two-sided adhesive tape. The half-cut mechanism 81 may cut up all film tapes, for example, between the two-sided adhesive tape and the film tapes. In the case of the laminate type, the two-sided adhesive tape and the film tapes correspond to the "print medium" of the present teaching. When using the tape cassette 30 fitting a tape of the tube type, the half-cut mechanism 81 may form a notch by cutting up part of the tube tape along the diameter, for example. The half-cut mechanism 81 cuts up the adhesive tape 38 of the print tape 37. However, the half-cut mechanism 81 may cup up the release paper 39 instead. The half-cut mechanism 81 may cut up all of the release paper 39 and part of the adhesive tape 38 of the print tape 37.

In the aforementioned embodiment, the half-cut mechanism 81 and the full-cut mechanism 85 use the cutting blades different from each other (the cutting blade 83 and the movable blade 87). However, one blade may be used to enable both the half-cut operation and the full-cut operation. For example, the cutting mechanism 80 may include the movable blade 87 as the one blade. In this case, the pedestal 82 may have a half-cut surface having a recess and a flat full-cut surface. The printing apparatus 1 may move the pedestal 82 between the position where the half-cut surface of the pedestal 82 faces the movable blade 87, and the position where the full-cut surface of the pedestal 82 faces the movable blade 87. In this case, the position where the tape is cut up in the full-cut operation consists with the position where the tape is cut up in the half-cut operation. Hence, it becomes easy for the separation distance Z to consist with the length of the print tape 37 on the conveyance path L between the printing position T1 and the cutting position T2. Therefore, the printing apparatus 1 may control the conveying, printing, and cutting with high precision.

The separation distance Z may not be the distance along the conveyance path L between the printing position T1 and the cutting position T2. The separation distance Z may be a distance along the conveyance path L between the printing position T1 and a third position. The third position is located on the conveyance path L between the printing position T1 and the cutting position T2. A particular example of the third position will be explained. For example, the printing apparatus 1 may wind back the tape by a predetermined length upstream along the conveying direction after the tape is cut up in the full-cut operation in S39. In particular, the printing apparatus 1 may include a motor for winding back the tape. The CPU 21 may control the motor for winding back the tape to rotate the first tape spool 40 by such an amount as to correspond to the predetermined length in a direction of winding back the tape (in the counterclockwise direction in planar view in FIG. 2). In this case, it is preferable for the separation distance Z to be the difference between the distance along the conveyance path L between the printing position T1 and the cutting position T2, and the length of winding back the tape in the conveying direction. On this occasion, the third position indicates the position of the downstream end of the tape when wound back on the conveyance path L in the conveying direction. The third position may be where the half-cut mechanism 81 cuts up the tape on the conveyance path L. In detail, it may be where the cutting blade 83 intersects the conveyance path L in the half-cut operation. In the aforementioned embodiment, the conveyance path L is a straight line extending between the printing position T1 and the cutting position T2. However, without being limited to this, it may be flexed, for example.

Instead of the CPU 21, it is possible to use, as the processor, a microcomputer, an ASIC (Application Specific Integrated Circuits), an FPGA (Field Programmable Gate Array), and the like. The main process and the like may be distributed to a plurality of processors. The ROM 22 and the flash memory 25 may not include a transitory storage medium (to store transmission signals, for example). The programs may be downloaded from, for example, a server connected to a network (that is, transmitted as transmission signals), and stored in the flash memory 25. In this case, the programs shall be stored in a non-transitory storage medium such as an HDD or the like provided in the server.

What is claimed is:

1. A printing apparatus comprising:

a conveyor configured to convey an elongate print medium along a conveyance path;

a print head configured to execute printing on the print medium at a first position along the conveyance path;

a cutter configured to cut the print medium at least partially at a second position on a downstream side of the first position in the conveyance path; and a processor configured to control the conveyor, the print head, and the cutter, wherein the processor is configured to:

acquire a specified length along the conveyance path;

acquire a first margin length along a conveyance direction in a first margin part provided in the print medium on the downstream side in the conveyance direction from a print part where printing is carried out;

acquire a separation distance along the conveyance path between the first position and a third position which includes the second position, the third position being located on the conveyance path between the first position and the second position; and determine whether the separation distance is equal to or longer than a first total length which is the total of the specified length and the first margin length, if the processor determines that the separation distance is equal to or longer than the first total length, the processor is configured to execute:

a first process of letting the conveyor start conveying the print medium and letting the print head start printing on the print medium, printing on the print medium while conveying the print medium by a first differential length which is the difference between the separation distance and the first margin length, and then letting the conveyor stop conveying the print medium and letting the print head stop printing on the print medium;

a second process of letting the cutter partially cut the print medium after the first process; and a third process of letting the conveyor restart conveying and letting the print head restart printing after the second process, to print on the print medium while conveying the print medium, if the processor determines that the separation distance is shorter than the first total length, the processor is configured to determine whether the first margin length is equal to or longer than the separation distance;

if the processor determines that the first margin length is equal to or longer than the separation distance, the processor is configured to execute:

a fourth process of letting the conveyor start conveying the print medium, conveying the print medium by the specified length, and then letting the conveyor stop conveying the print medium;

a fifth process of letting the cutter partially cut the print medium after the fourth process;

a sixth process of letting the conveyor restart conveying the print medium after the fifth process; and a seventh process of letting the print head start to print on the print medium when the print medium is conveyed by the first differential length after the sixth process, to print on the print medium while conveying the print medium; and if the processor determines that the first margin length is shorter than the separation distance, the processor is configured to execute:

an eighth process of letting the conveyor start conveying the print medium;

a ninth process of letting the print head start printing on the print medium when the print medium is conveyed by the differential length between the separation distance and the first total length after the eighth process, letting the print head print on the print medium while conveying the print medium by the first differential length, and then letting the conveyor stop conveying the print medium and letting the print head stop printing on the print medium;

a tenth process of letting the cutter partially cut the print medium after the ninth process; and an eleventh process of letting the conveyor restart conveying the print medium and letting the print head restart printing on the print medium after the tenth process, to print on the print medium while conveying the print medium.

2. The printing apparatus according to claim 1, further comprising an input unit configured to accept an input of the specified length, wherein the processor acquires the specified length accepted by the input unit.

3. The printing apparatus according to claim 1, wherein the processor is further configured to:

acquire print data for printing a print image including a character line having at least one character; and if the print image includes a first blank area which is positioned on the downstream side from the character line in the conveyance direction and in which the print head does not print the character line, acquire a first blank length of the first blank area along the conveyance direction, the processor determines whether the separation distance is equal to or longer than a second total length which is the total of the first total length and the first blank length, if the processor determines that the separation distance is equal to or longer than the second total length, as the first process, the processor is configured to:

let the conveyor start conveying the print medium and let the print head start printing on the print medium;

let the print head print on the print medium while conveying the print medium by a second differential length which is the difference between the separation distance and a third total length, the third total length being the total of the first margin length and the first blank length; and let the conveyor stop conveying the print medium and let the print head stop printing on the print medium, if the processor determines that the separation distance is shorter than the second total length, the processor is configured to determine whether the third total length is equal to or longer than the separation distance, if the processor determines that the third total length is equal to or longer than the separation distance, as the seventh process, the processor is configured to let the print head start printing on the print medium when the print medium is conveyed by the second differential length after the sixth process, to print on the print medium while conveying the print medium, and if the processor determines that the third total length is shorter than the separation distance, as the eleventh process, the processor is configured to:

let the print head start printing on the print medium when the print medium is conveyed by the differential length between the separation distance and the second total length after the eighth process;

let the print head print on the print medium while conveying the print medium by second differential length; and let the conveyor stop conveying the print medium and let the print head stop printing on the print medium.

4. The printing apparatus according to claim 3, wherein the processor is further configured to:

acquire a second margin length along the conveyance direction in a second margin part, which is provided in the print medium on an upstream side of the print part in the conveyance direction;

if the print image includes a second blank area which is positioned on the upstream side from the character line in the conveyance direction and in which the print head does not print the character line, acquire a second blank length of the second blank area along the conveyance direction; and determine whether the third total length is equal to or longer than a fourth total length which is the total of the second margin length and the second blank length, if the processor determines that the third total length is shorter than the fourth total length, the processor is configured to:

convert the print data into new print data for printing the print image rotated by 180 degrees;

interchange the third total length and the fourth total length; and execute any one set of the first process to the third process, the fourth process to the seventh process, and the eighth process to the eleventh process, based on the interchanged third total length and fourth total length, and the new print data, and if the processor determines that the third total length is equal to or longer than the fourth total length, the processor is configured to execute any one set of the first process to the third process, the fourth process to the seventh process, and the eighth process to the eleventh process, based on the third total length and fourth total length, and the print data.

5. The printing apparatus according to claim 1, wherein the third position is the second position at which the print medium is fully cut by the cutter.

6. The printing apparatus according to claim 1, wherein the print medium is a print tape including an adhesive tape having a print surface on which printing is carried out and an adhesive surface on the other side of the print surface and having an adhesive layer, and a release paper stuck on the adhesive surface, the cutter is configured to cut any one of the print tape and the release paper, the printing apparatus further comprises:

an installation portion in which a tape cassette having the print tape is removably installed; and a sensor configured to detect a tape type of the print tape included in the tape cassette which is installed in the installation portion, and the processor is configured to determine whether the tape type of the print tape is a specific print tape comprising the release paper with a notch and the adhesive tape, and if the processor determines that the tape type of the print tape is the specific print tape, then the processor acquires zero as the specified length.

* * * * *